US010329845B2

(12) United States Patent
Chen

(10) Patent No.: US 10,329,845 B2
(45) Date of Patent: Jun. 25, 2019

(54) ROTARY DRILL BIT INCLUDING MULTI-LAYER CUTTING ELEMENTS

(71) Applicant: Halliburton Energy Services, Inc., Houston, TX (US)

(72) Inventor: Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 450 days.

(21) Appl. No.: 15/034,143

(22) PCT Filed: Dec. 6, 2013

(86) PCT No.: PCT/US2013/073583

§ 371 (c)(1),
(2) Date: May 3, 2016

(87) PCT Pub. No.: WO2015/084394

PCT Pub. Date: Jun. 11, 2015

(65) Prior Publication Data

US 2016/0281437 A1 Sep. 29, 2016

(51) Int. Cl.
*E21B 10/43* (2006.01)
*E21B 10/46* (2006.01)
(Continued)

(52) U.S. Cl.
CPC ..... *E21B 10/43* (2013.01); *E21B 7/04* (2013.01); *E21B 7/046* (2013.01); *E21B 10/46* (2013.01); *E21B 10/60* (2013.01)

(58) Field of Classification Search
CPC . E21B 10/43; E21B 7/04; E21B 7/046; E21B 10/46; E21B 10/60
See application file for complete search history.

(56) References Cited

U.S. PATENT DOCUMENTS 3,153,458 A 10/1964 Short
4,554,986 A 11/1985 Jones
(Continued)

FOREIGN PATENT DOCUMENTS

CN 2451714 Y 10/2001
CN 10427000 5/2009
(Continued)

OTHER PUBLICATIONS

Chinese Office Action Application No. 201280074423.7, dated Aug. 17, 2016, 13 pages.
(Continued)

*Primary Examiner* — Yong-Suk Ro
(74) *Attorney, Agent, or Firm* — Baker Botts L.L.P.

(57) ABSTRACT

A multi-layer downhole drilling tool designed for drilling a wellbore including a plurality of formations includes a bit body and a plurality of primary blades and secondary blades with respective leading surfaces on exterior portions of the bit body. The drilling tool further includes a plurality of first layer cutting elements and second layer cutting elements located on the leading surfaces of the primary blades and secondary blades, respectively. Each second layer cutting element is under-exposed with respect to the corresponding first layer cutting element. The amount of under-exposure is selected according to each second layer cutting element having an initial critical depth of cut greater than an actual depth of cut for a first drilling distance and a critical depth of cut equal to zero at a target drilling depth.

9 Claims, 21 Drawing Sheets

(51) Int. Cl.
*E21B 7/04* (2006.01)
*E21B 10/60* (2006.01)

(56) References Cited

U.S. PATENT DOCUMENTS

| | | | | |
|---|---|---|---|---|
| 4,991,670 | A | 2/1991 | Fuller et al. | |
| 5,090,492 | A | 2/1992 | Keith | |
| 5,265,685 | A | 11/1993 | Keith et al. | |
| 5,549,171 | A | 8/1996 | Mensa-Wilmot et al. | |
| 5,551,522 | A | 9/1996 | Keith et al. | |
| 5,582,261 | A | 12/1996 | Keith et al. | |
| 5,595,252 | A | 1/1997 | O'Hanlon | |
| 5,607,024 | A | 3/1997 | Keith et al. | |
| 6,089,336 | A | 7/2000 | Nexton | |
| 6,109,368 | A | 8/2000 | Goldman et al. | |
| 6,298,930 | B1 | 10/2001 | Sinor et al. | |
| 6,408,953 | B1 | 6/2002 | Goldman et al. | |
| 6,460,631 | B2 | 10/2002 | Dykstra et al. | |
| 6,779,613 | B2 | 8/2004 | Dykstra et al. | |
| 6,935,441 | B2 | 8/2005 | Dykstra et al. | |
| 7,032,689 | B2 | 4/2006 | Goldman et al. | |
| 7,096,978 | B2 | 8/2006 | Dykstra et al. | |
| 7,261,167 | B2 | 8/2007 | Goldman et al. | |
| 7,357,196 | B2 | 4/2008 | Goldman et al. | |
| 7,360,608 | B2 | 4/2008 | Brackin et al. | |
| 7,464,774 | B2 | 12/2008 | Savignat et al. | |
| 7,624,818 | B2 | 12/2009 | McClain et al. | |
| 7,703,557 | B2 | 4/2010 | Durairajan et al. | |
| 7,762,355 | B2 | 7/2010 | McClain et al. | |
| 7,861,809 | B2 | 1/2011 | Gavia et al. | |
| 7,866,413 | B2 | 1/2011 | Stauffer et al. | |
| 8,863,860 | B2 | 10/2014 | Chen et al. | |
| 8,985,244 | B2 * | 3/2015 | Patel | E21B 10/46 175/374 |
| 2001/0030063 | A1 | 10/2001 | Dykstra et al. | |
| 2005/0010382 | A1 | 1/2005 | Oliver et al. | |
| 2005/0080595 | A1 | 4/2005 | Huang | |
| 2006/0278436 | A1 | 12/2006 | Dykstra et al. | |
| 2007/0078632 | A1 | 4/2007 | Shen | |
| 2007/0151770 | A1 | 7/2007 | Ganz | |
| 2007/0186639 | A1 | 8/2007 | Spross et al. | |
| 2007/0267227 | A1 | 11/2007 | Mensa-Wilmot | |
| 2008/0041629 | A1 | 2/2008 | Aronstam et al. | |
| 2008/0135297 | A1 | 6/2008 | Gavia | |
| 2009/0090556 | A1 | 4/2009 | Chen | |
| 2009/0166091 | A1 | 7/2009 | Matthews et al. | |
| 2009/0266619 | A1 | 10/2009 | Durairajan et al. | |
| 2010/0000800 | A1 | 1/2010 | Chen et al. | |
| 2010/0025121 | A1 * | 2/2010 | Schwefe | E21B 10/43 175/431 |
| 2010/0089664 | A1 | 4/2010 | Welch et al. | |
| 2010/0193248 | A1 | 8/2010 | Radford et al. | |
| 2010/0263937 | A1 | 10/2010 | Overstreet et al. | |
| 2011/0030063 | A1 | 10/2011 | Choi | |
| 2012/0111630 | A1 | 5/2012 | Chen et al. | |
| 2012/0205163 | A1 * | 8/2012 | Azar | E21B 10/26 175/428 |
| 2013/0035903 | A1 | 2/2013 | Prevost | |
| 2013/0228378 | A1 | 9/2013 | Chen et al. | |
| 2013/0233621 | A1 | 9/2013 | Chen et al. | |
| 2013/0238245 | A1 | 9/2013 | Chen et al. | |
| 2013/0253836 | A1 | 9/2013 | Chen et al. | |
| 2015/0122551 | A1 | 5/2015 | Chen | |
| 2015/0152689 | A1 | 6/2015 | Chen et al. | |

FOREIGN PATENT DOCUMENTS

| | | |
|---|---|---|
| CN | 101460701 | 6/2009 |
| CN | 101611213 A | 12/2009 |
| CN | 102216554 A | 10/2011 |
| GB | 2498480 | 7/2013 |
| WO | 2012/064948 | 5/2012 |
| WO | 2012/064953 | 5/2012 |
| WO | 2012/064961 | 5/2012 |
| WO | 2013/180702 | 12/2013 |

OTHER PUBLICATIONS

Chinese Office Action Application No. 201280074423.7, dated Mar. 2, 2017; 7 pages.
Canadian Office Action Application No. 2929078, dated Apr. 3, 2017, 4 pages.
Canadian Office Action Application No. 2879046, dated Mar. 27, 2017, 4 pages.
Chinese Office Action Application No. 201380080165.8, dated May 3, 2017; 13 pages.
Office Action for Canadian Patent Application No. 2879046, dated Dec. 15, 2017; 4 pages.
International Preliminary Report on Patentability of PCT/US2013/073583, dated Jun. 16, 2016, 9 pages.
European Extended Search Report of Application No. 12880858.1 dated Jan. 4, 2016, 5 pages.
International Preliminary Report on Patentability, PCT Application No. PCT/US2012/039977, 7 pages, dated Dec. 2, 2014.
International Search Report and Written Opinion, Application No. PCT/US2012/039977, 13 pages, dated Aug. 12, 2012.
Mensa-Wilmot, Graham, "Innovation Cutting Structure, With Staged ROP and Durability Characteristics, Extends PDC Bit Efficiency Into Chert/Pyrite/Conglomerate Applications," Society of Petroleum Engineers 105320, 15th SPE Middle East Oil & Gas Show and Conference, Kingdom of Bahrain, Mar. 11-14, 2007, Mar. 11, 2007.
International Preliminary Report on Patentability issued in PCT/US2012/053761; 6 pages, dated Jan. 13, 2015.
International Search Report and Written Opinion, Application No. PCT/US2012/053761, 17 pages, dated Feb. 4, 2013.
Canadian Office Action Application No. 2879046, dated Feb. 24, 2016, 4 pages.
Canadian Office Action Application No. 2875021, dated Jan. 13, 2016, 4 pages.
Examination Report, Application No. GB1420604.9; 3 pages, dated Jun. 26, 2016.
Chinese Office Action, Application No. 201280074423.7; with translation; 14 pages, dated Dec. 2, 2015.

* cited by examiner

ROTARY DRILL BIT INCLUDING MULTI-LAYER CUTTING ELEMENTS

RELATED APPLICATION

This application is a U.S. National Stage Application of International Application No. PCT/US2013/073583 filed Dec. 6, 2013, which designates the United States, and which is incorporated herein by reference in its entirety.

TECHNICAL FIELD

The present disclosure relates generally to downhole drilling tools and, more particularly, to rotary drill bits and methods for designing rotary drill bits with multi-layer cutting elements.

BACKGROUND

Various types of downhole drilling tools including, but not limited to, rotary drill bits, reamers, core bits, and other downhole tools have been used to form wellbores in associated downhole formations. Examples of such rotary drill bits include, but are not limited to, fixed cutter drill bits, drag bits, polycrystalline diamond compact (PDC) drill bits, and matrix drill bits associated with forming oil and gas wells extending through one or more downhole formations. Fixed cutter drill bits such as PDC bits may include multiple blades that each include multiple cutting elements.

In typical drilling applications, a PDC bit may be used to drill through various levels or types of geological formations with longer bit life than non-PDC bits. Typical formations may generally have a relatively low compressive strength in the upper portions (e.g., lesser drilling depths) of the formation and a relatively high compressive strength in the lower portions (e.g., greater drilling depths) of the formation. Thus, it typically becomes increasingly more difficult to drill at increasingly greater depths. Additionally, cutting elements on the drill bit may experience increased wear as drilling depth increases.

BRIEF DESCRIPTION OF THE DRAWINGS

A more complete understanding of the present disclosure and its features and advantages thereof may be acquired by referring to the following description, taken in conjunction with the accompanying drawings, in which like reference numbers indicate like features, and wherein.

DETAILED DESCRIPTION

Embodiments of the present disclosure and its advantages are best understood by referring to FIGS. 1-11, where like numbers are used to indicate like and corresponding parts.

Figure 1:
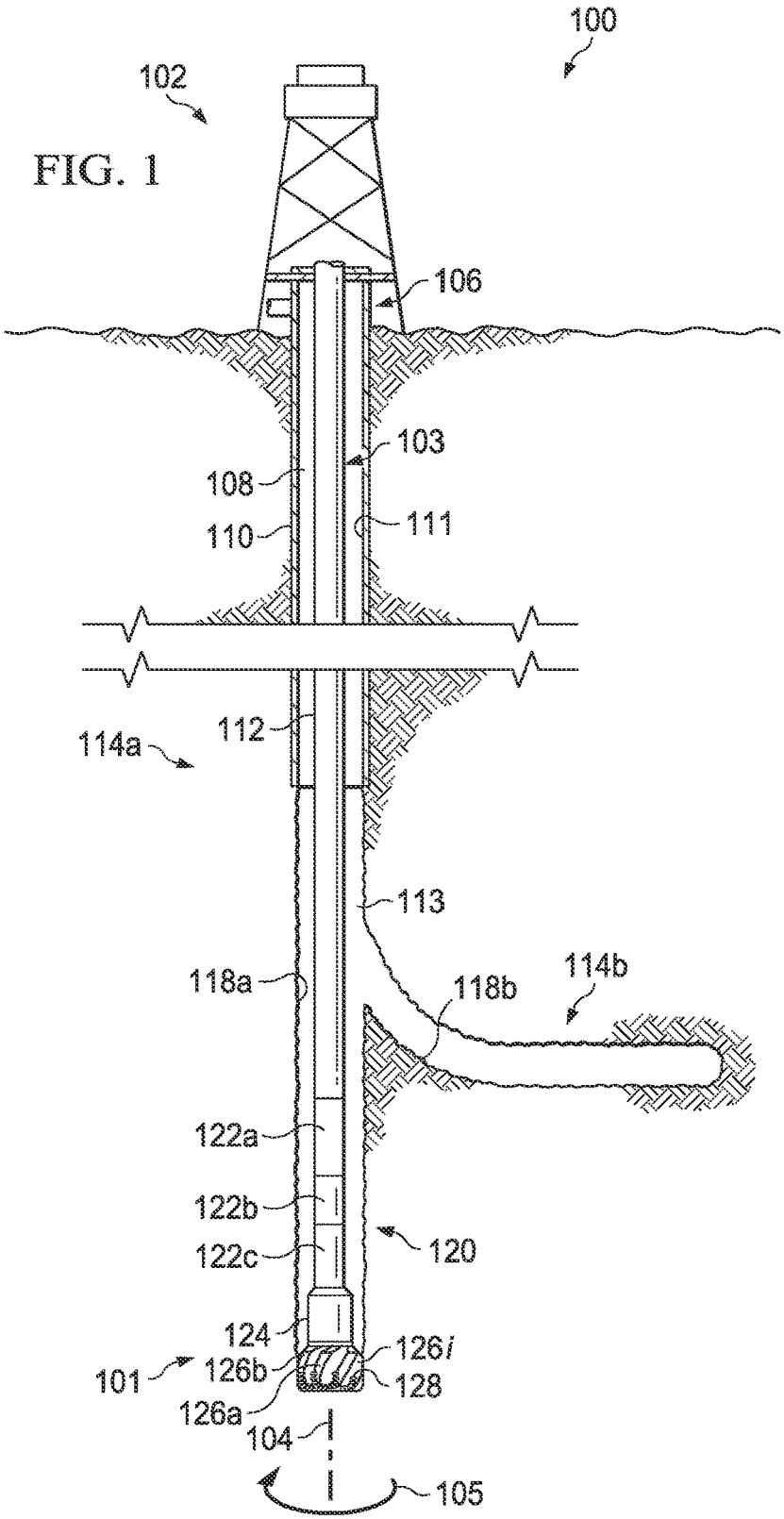
FIG. 1 illustrates an elevation view of an example embodiment of a drilling system, in accordance with some embodiments of the present disclosure.

FIG. 1 illustrates an elevation of an example embodiment of a drilling system, in accordance with some embodiments of the present disclosure. Drilling system 100 is configured to provide drilling into one or more geological formations, in accordance with some embodiments of the present disclosure. Drilling system 100 may include a well surface, sometimes referred to as "well site" 106. Various types of drilling equipment such as a rotary table, mud pumps and mud tanks (not expressly shown) may be located at a well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may include drill string 103 associated with drill bit 101 that may be used to form a wide variety of wellbores or bore holes such as generally vertical wellbore 114*a* or generally horizontal wellbore 114*b* as shown in FIG. 1. Various directional drilling techniques and associated components of bottom hole assembly (BHA) 120 of drill string 103 may be used to form generally horizontal wellbore 114*b*. For example, lateral forces may be applied to drill bit 101 proximate kickoff location 113 to form generally horizontal wellbore 114*b* extending from generally vertical wellbore 114*a*. The term "directional drilling" may be used to describe drilling a wellbore or portions of a wellbore that extend at a desired angle or angles relative to vertical. Such angles may be greater than normal variations associated with vertical wellbores. Direction drilling may also be described as drilling a wellbore deviated from vertical. The term "horizontal drilling" may be used to include drilling in a direction approximately ninety degrees (90°) from vertical.

BHA 120 may be formed from a wide variety of components configured to form a wellbore 114. For example, components 122*a*, 122*b* and 122*c* of BHA 120 may include, but are not limited to, drill bits (e.g., drill bit 101) drill collars, rotary steering tools, directional drilling tools, downhole drilling motors, drilling parameter sensors for weight, torque, bend and bend direction measurements of the drill string and other vibration and rotational related sensors, hole enlargers such as reamers, under reamers or hole openers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number of components such as drill collars and different types of components 122 included in BHA 120 may depend upon anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of such logging tools and/or directional drilling tools may include, but are not limited to, acoustic, neutron, gamma ray, density, photoelectric, nuclear magnetic resonance, rotary steering tools and/or any other commercially available well tool.

Wellbore 114 may be defined in part by casing string 110 that may extend from well surface 106 to a selected downhole location. Portions of wellbore 114 as shown in FIG. 1 that do not include casing string 110 may be described as "open hole." In addition, liner sections (not expressly shown) may be present and may connect with an adjacent casing or liner section. Liner sections (not expressly shown) may not extend to the well site 106. Liner sections may be positioned proximate the bottom, or downhole, from the previous liner or casing. Liner section may extend to the end of wellbore 114. Various types of drilling fluid may be pumped from well surface 106 through drill string 103 to attached drill bit 101. Such drilling fluids may be directed to flow from drill string 103 to respective nozzles (item 156 illustrated in FIG. 2) included in rotary drill bit 101. The drilling fluid may be circulated back to well surface 106 through an annulus 108 defined in part by outside diameter 112 of drill string 103 and inside diameter 118 of wellbore 114. Inside diameter 118 may be referred to as the "sidewall" or "bore wall" of wellbore 114. Annulus 108 may also be defined by outside diameter 112 of drill string 103 and inside diameter 111 of casing string 110. Open hole annulus 116 may be defined as sidewall 118 and outside diameter 112.

Drilling system 100 may also include rotary drill bit ("drill bit") 101. Drill bit 101, discussed in further detail in FIG. 2, may include one or more blades 126 that may be disposed outwardly from exterior portions of rotary bit body 124 of drill bit 101. Rotary bit body 124 may have a generally cylindrical body and blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may include one or more depth of cut controllers (not expressly shown) configured to control the depth of cut of cutting elements 128. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

Drilling system 100 may include one or more second layer cutting elements on a drill bit that are configured to cut into the geological formation at particular drilling depths and/or when first layer cutting elements experience sufficient wear. Thus, multiple layers of cutting elements may exist that engage with the formation at multiple drilling depths. Placement and configuration of the first layer and second layer cutting elements on blades of a drill bit may be varied to enable the different layers to engage at specific drilling depths. For example, configuration considerations may include under-exposure and blade placement of second layer cutting elements with respect to first layer cutting elements, and/or characteristics of the formation to be drilled. Cutting elements may be arranged in multiple layers on blades such that second layer cutting elements may engage the formation when the depth of cut is greater than a specified value and/or when first layer cutting elements are sufficiently worn. In some embodiments, the drilling tools may have first layer cutting elements arranged on blades in a single-set or a track-set configuration. Second layer cutting elements may be arranged on different blades that are track-set and under-exposed with respect to the first layer cutting elements. In some embodiments, the amount of under-exposure may be approximately the same for each of the second layer cutting elements. In other embodiments, the amount of under-exposure may vary for each of the second layer cutting elements.

Figure 2:
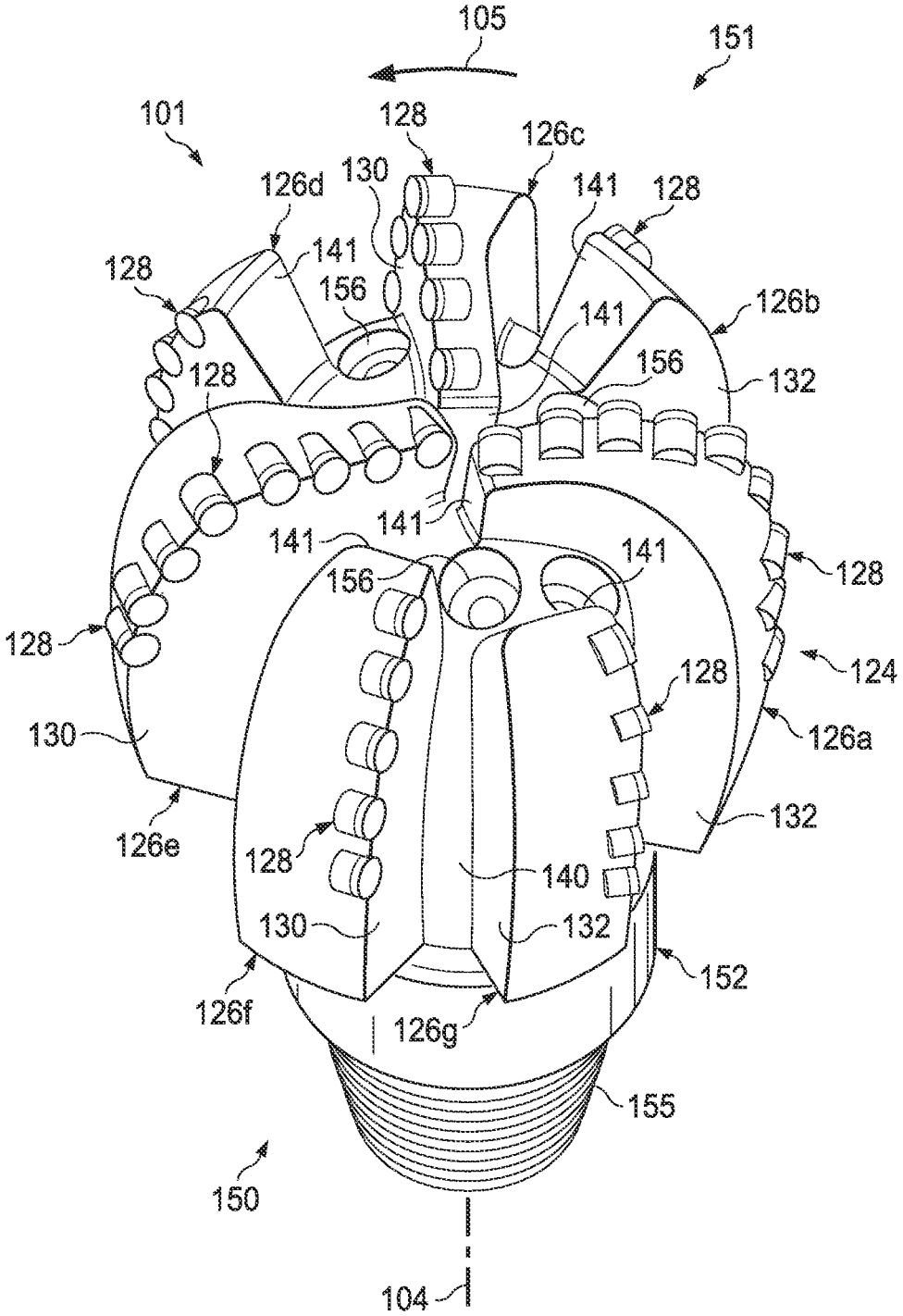
FIG. 2 illustrates an isometric view of a rotary drill bit oriented upwardly in a manner often used to model or design fixed cutter drill bits, in accordance with some embodiments of the present disclosure.

FIG. 2 illustrates an isometric view of rotary drill bit 101 oriented upwardly in a manner often used to model or design fixed cutter drill bits, in accordance with some embodiments of the present disclosure. Drill bit 101 may be any of various types of fixed cutter drill bits, including PDC bits, drag bits, matrix drill bits, and/or steel body drill bits operable to form wellbore 114 extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*g*) that may be disposed outwardly from exterior portions of rotary bit body 124 of drill bit 101. Rotary bit body 124 may be generally cylindrical and blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126 formed in accordance with teachings of the present disclosure may have a wide variety of configurations including, but not limited to, substantially arched, helical, spiraling, tapered, converging, diverging, symmetrical, and/or asymmetrical.

In some embodiments, blades 126 may have substantially arched configurations, generally helical configurations, spiral shaped configurations, or any other configuration satisfactory for use with each downhole drilling tool. One or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Each of blades 126 may include a first end disposed proximate or toward bit rotational axis 104 and a second end disposed proximate or toward exterior portions of drill bit 101 (e.g., disposed generally away from bit rotational axis 104 and toward uphole portions of drill bit 101). The terms "uphole" and "downhole" may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Blades 126*a*-126*g* may include primary blades disposed about the bit rotational axis. For example, in FIG. 2, blades 126*a*, 126*c*, and 126*e* may be primary blades or major blades because respective first ends 141 of each of blades 126*a*, 126*c*, and 126*e* may be disposed closely adjacent to bit rotational axis 104 of drill bit 101. In some embodiments, blades 126*a*-126*g* may also include at least one secondary blade disposed between the primary blades. In the illustrated embodiment, blades 126*b*, 126*d*, 126*f*, and 126*g* shown in FIG. 2 on drill bit 101 may be secondary blades or minor blades because respective first ends 141 may be disposed on downhole end 151 of drill bit 101 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the location of blades 126 may be based on the downhole drilling conditions of the drilling environment. In some cases, blades 126 and drill bit 101 may rotate about rotational axis 104 in a direction defined by directional arrow 105.

Each blade may have leading (or front) surface (or face) 130 disposed on one side of the blade in the direction of rotation of drill bit 101 and trailing (or back) surface (or face) 132 disposed on an opposite side of the blade away from the direction of rotation of drill bit 101. Blades 126 may be positioned along bit body 124 such that they have a spiral configuration relative to rotational axis 104. In other embodiments, blades 126 may be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. By way of example and not limitation, cutting elements 128 may be various types of cutters, compacts, buttons, inserts, and gage cutters satisfactory for use with a wide variety of drill bits 101.

Cutting elements 128 may be any suitable device configured to cut into a formation, including but not limited to, primary cutting elements, back-up cutting elements, secondary cutting elements or any combination thereof. Primary cutting elements may be described as first layer or second layer cutting elements. First layer cutting elements may be disposed on leading surfaces 130 of primary blades, e.g. blades 126*a*, 126*c*, and 126*e*. Second layer cutting elements may be disposed on leading surfaces 130 of secondary blades, e.g., blades 126*b*, 126*d*, 126*f*, and 126*g*.

Cutting elements 128 may include respective substrates with a layer of hard cutting material disposed on one end of each respective substrate. The hard layer of cutting elements 128 may provide a cutting surface that may engage adjacent portions of a downhole formation to form wellbore 114. The contact of the cutting surface with the formation may form a cutting zone associated with each of cutting elements 128. The edge of the cutting surface located within the cutting zone may be referred to as the cutting edge of a cutting element 128.

Each substrate of cutting elements 128 may have various configurations and may be formed from tungsten carbide or other suitable materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds.

In some embodiments, blades 126 may also include one or more depth of cut controllers (DOCCs) (not expressly shown) configured to control the depth of cut of cutting elements 128. A DOCC may include an impact arrestor, a back-up or second layer cutting element and/or a Modified Diamond Reinforcement (MDR). Exterior portions of blades 126, cutting elements 128 and DOCCs (not expressly shown) may form portions of the bit face.

Blades 126 may further include one or more gage pads (not expressly shown) disposed on blades 126. A gage pad may be a gage, gage segment, or gage portion disposed on exterior portion of blade 126. Gage pads may contact adjacent portions of wellbore 114 formed by drill bit 101. Exterior portions of blades 126 and/or associated gage pads may be disposed at various angles, positive, negative, and/or parallel, relative to adjacent portions of generally vertical wellbore 114*a*. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120 whereby drill bit 101 may be rotated relative to bit rotational axis 104. Downhole end 151 of drill bit 101 may include a plurality of blades 126*a*-126*g* with respective junk slots or fluid flow paths 140 disposed therebetween. Additionally, drilling fluids may be communicated to one or more nozzles 156.

Drill bit operation may be expressed in terms of depth of cut per revolution as a function of drilling depth. Depth of cut per revolution, or "depth of cut," may be determined by rate of penetration (ROP) and revolution per minute (RPM). ROP may represent the amount of formation that is removed as drill bit 101 rotates and may be in units of ft/hr. Further, RPM may represent the rotational speed of drill bit 101. For example, drill bit 101 utilized to drill a formation may rotate at approximately 120 RPM. Actual depth of cut (Δ) may represent a measure of the depth that cutting elements cut into the formation during a rotation of drill bit 101. Thus, actual depth of cut may be expressed as a function of actual ROP and RPM using the following equation:

$$\Delta = ROP/(5*RPM).$$

Actual depth of cut may have a unit of in/rev.

Multiple formations of varied formation strength may be drilled using drill bits configured in accordance with some embodiments of the present disclosure. As drilling depth increases, formation strength may likewise increase. For example, a first formation may extend from the surface to a drilling depth of approximately 2,200 feet and may have a rock strength of approximately 5,000 pounds per square inch (psi). Additionally, a second formation may extend from a drilling depth of approximately 2,200 feet to a drilling depth of approximately 4,800 feet and may have rock strength of approximately 25,000 psi. As another example, a third formation may extend from a drilling depth of approximately 4,800 feet to a drilling depth of approximately 7,000 feet and may have a rock strength over approximately 20,000 psi. A fourth formation may extend from approximately 7,000 feet to approximately 8,000 feet and may have a rock strength of approximately 30,000 psi. Further, a fifth formation may extend beyond approximately 8,000 feet and have a rock strength of approximately 10,000 psi.

With increased drilling depth, formation strength or rock strength may increase or decrease and thus, the formation may become more difficult or may become easier to drill. For example, a drill bit including seven blades may drill through the first formation very efficiently, but a drill bit including nine blades may be desired to drill through the second and third formations.

Accordingly, as drill bit 101 drills into a formation, the first layer cutting elements may begin to wear as the drilling depth increases. For example, at a drilling depth of less than approximately 5,500 feet, the first layer cutting elements may have a wear depth of approximately 0.04 inches. At a drilling depth between approximately 5,500 feet and 8,500 feet, the first layer cutting elements may have an increased wear depth of approximately 0.15 inches. As first layer cutting elements wear, ROP of the drill bit may decrease, thus, resulting in less efficient drilling. Likewise, actual depth of cut for drill bit 101 may also decrease. Thus, second layer cutting elements that begin to cut into the formation when the first layer cutting elements experience a sufficient amount of wear may improve the efficiency of drill bit 101 and may result in drill bit 101 having a longer useful life.

Accordingly, to extend the bit life, it may be desired that (1) second layer cutting elements not cut into the formation until drill bit 101 reaches a particular drilling depth; (2) second layer cutting elements begin to cut into the formation at a particular drilling depth; (3) second layer cutting elements cut the formation effectively; and (4) approximately all second layer cutting elements cut into the formation substantially simultaneously. Hence, drill bit 101 optimized for maximizing drilling efficiency and bit life may include:

(a) first layer cutting elements that cut into the formation from the surface to a first drilling depth ($D_A$);

(b) second layer cutting elements that begin to cut into the formation at $D_A$ (c) second layer cutting elements that cut efficiently based on formation properties; and (d) second layer cutting elements that cut substantially simultaneously.

Figure 3:
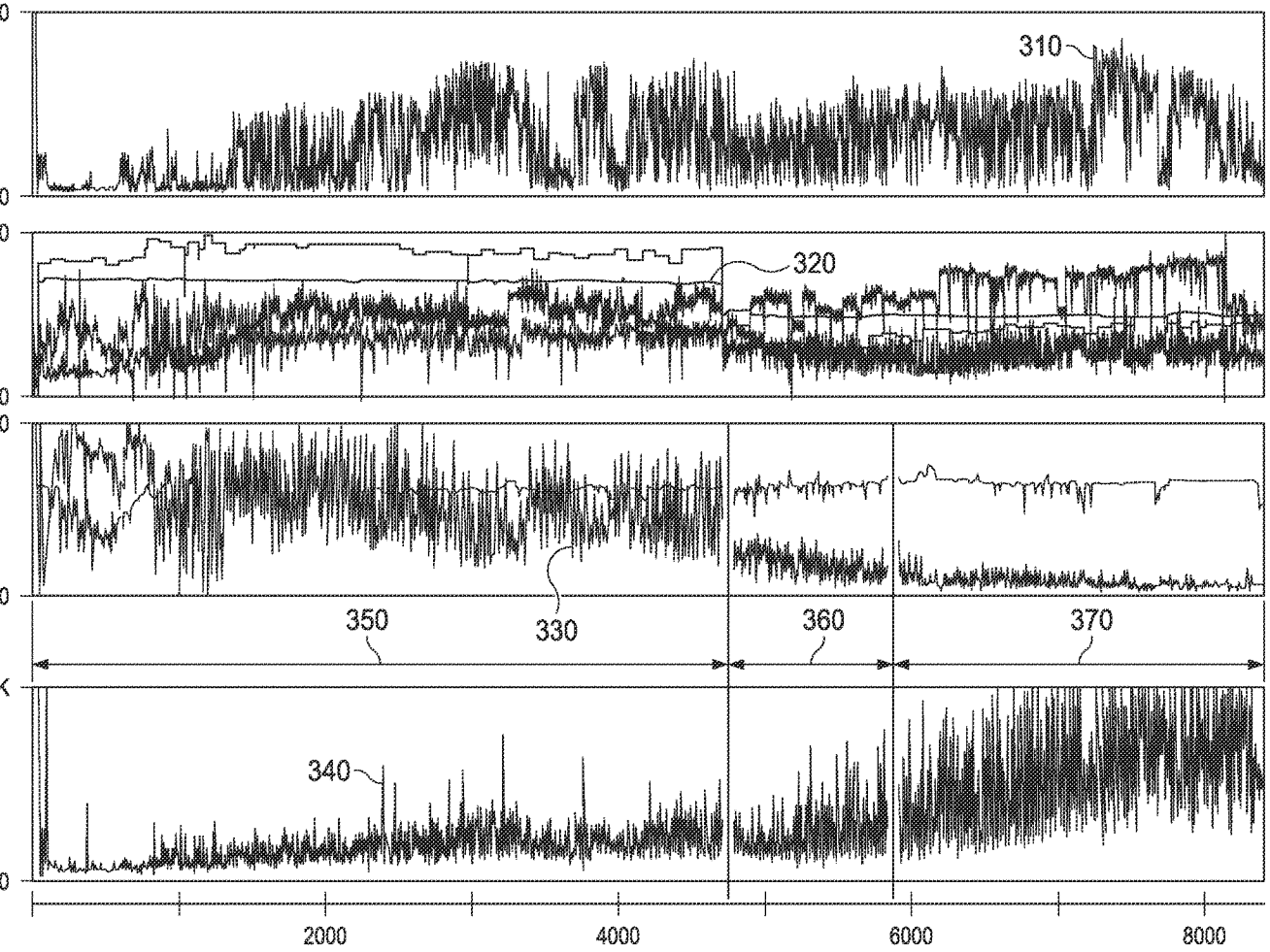
FIG. 3 illustrates a report of run information gathered from drilling a wellbore with a drill bit, in accordance with some embodiments of the present disclosure.

Improvement of the design of a drill bit may begin with actual performance of the bit when drilled into an offset well with a similar formation and similar operational parameters. FIG. 3 illustrates a report of run information 300 gathered from drilling a wellbore (e.g., wellbore 114 as illustrated in FIG. 1) with a drill bit, in accordance with some embodiments of the present disclosure. Drill bit run information may include, but is not limited to, rock strength, RPM, ROP, weight on bit (WOB), torque on bit (TOB), and mechanical specific energy (MSE). The run information may be measured at each foot drilled.

In the current example, rock strength, shown as plot 310, remained substantially constant during drilling. RPM of the drill bit, which is the sum of RPM of the drill string and the RPM of the downhole motor, shown as plot 320, and ROP, shown as plot 330, decreased at a drilling depth of approximately 4,800 feet. Additionally, MSE may be calculated using the run information. MSE may be a measure of the drilling efficiency of drill bit 101. In the illustrated embodiment, MSE increases after drilling approximately 4,800 feet, which may indicate that the drilling efficiency of the drill bit may decrease at depths over approximately 4,800 feet. Thus, drilling to approximately 4,800 feet may be described as high efficiency drilling 350. MSE additionally increases again at approximately 5,800 feet. Drilling between approximately 4,800 feet and 5,800 feet may be described as efficiency drilling 360, and drilling at depths over approximately 5,800 feet may be described as low efficiency drilling 370. MSE may indicate a further drop in drilling efficiency. The data shown in FIG. 3 may be obtained from various tools in the oil and gas drilling industry such as SPARTA™ analytical tools designed and manufactured by Halliburton Energy Services, Inc. (Houston, Tex.).

Figure 4A:
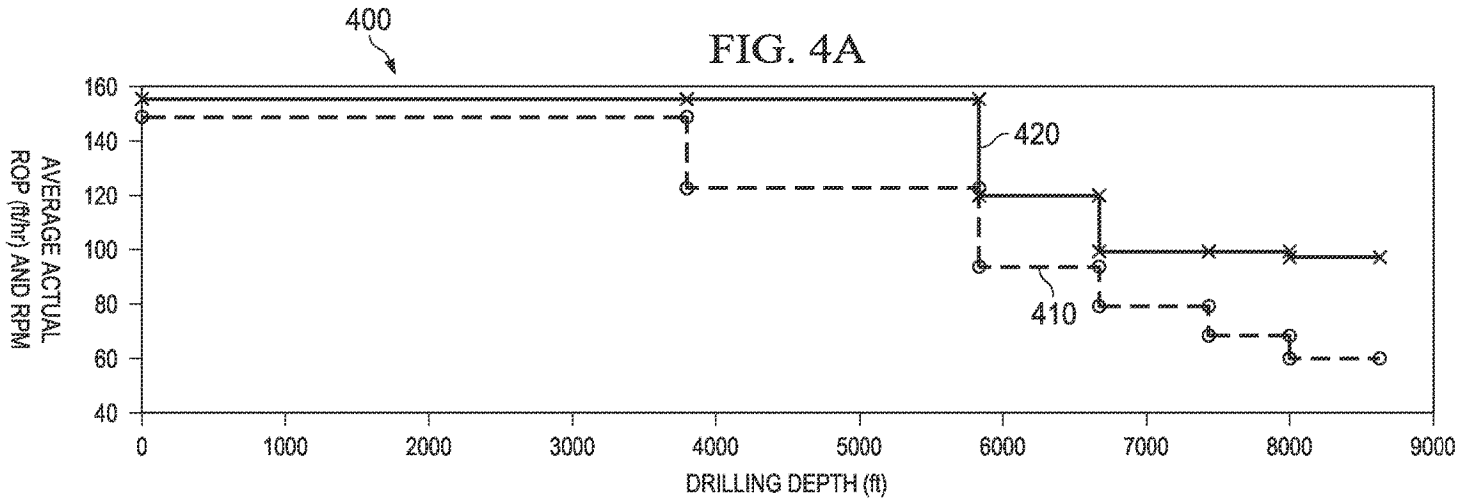
FIG. 4A illustrates a graph of actual average rate of penetration (ROP) and revolutions per minute (RPM) as a function of drilling depth as estimated in accordance with some embodiments of the present disclosure.

Using the gathered run information illustrated in FIG. 3, the average ROP and average RPM for a specified drilling section may be plotted as a function of drilling distance. Accordingly, FIG. 4A illustrates graph 400 of actual average ROP and actual average RPM as a function of drilling depth as estimated in accordance with some embodiments of the present disclosure. For example, from the drilling start point to a drilling depth of approximately 3,800 feet, actual average ROP, plot 410, may be approximately 150 ft/hr. Corresponding average RPM, plot 420, in this section of formation may be approximately 155. At a drilling depth of approximately 3,800 feet, actual average ROP, plot 410 may decrease to approximately 120 ft/hr while average RPM, plot 420, remains approximately constant to a drilling depth of approximately 5,800 feet where it may begin to decrease. Thereafter, actual average ROP, plot 410, may continue to decrease as the drilling depth continues to increase.

Figure 4B:
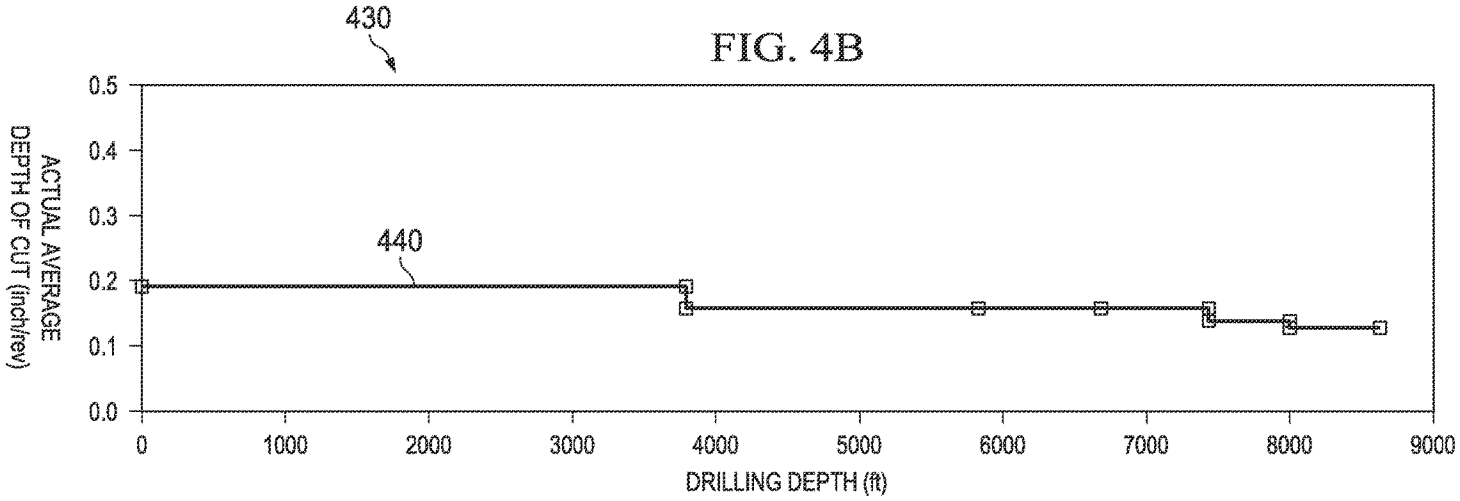
FIG. 4B illustrates a graph of actual average depth of cut as a function of drilling depth as estimated in accordance with some embodiments of the present disclosure.

Similarly, FIG. 4B illustrates graph 430 of actual average depth of cut as a function of drilling depth as estimated in accordance with some embodiments of the present disclosure. Actual depth of cut as a function of drilling depth may be shown by plot 440. For example, from the drilling start point to a drilling depth of approximately 3,800 feet, actual average depth of cut, plot 440, may be approximately 0.19 in/rev. At a drilling depth of approximately 3,800 feet, actual average depth of cut, plot 440, may decrease to approximately 0.15 in/rev. At a drilling depth of approximately 7,500 feet, actual average depth of cut, plot 440, may begin to further decrease as the drilling depth increases.

Figure 5:
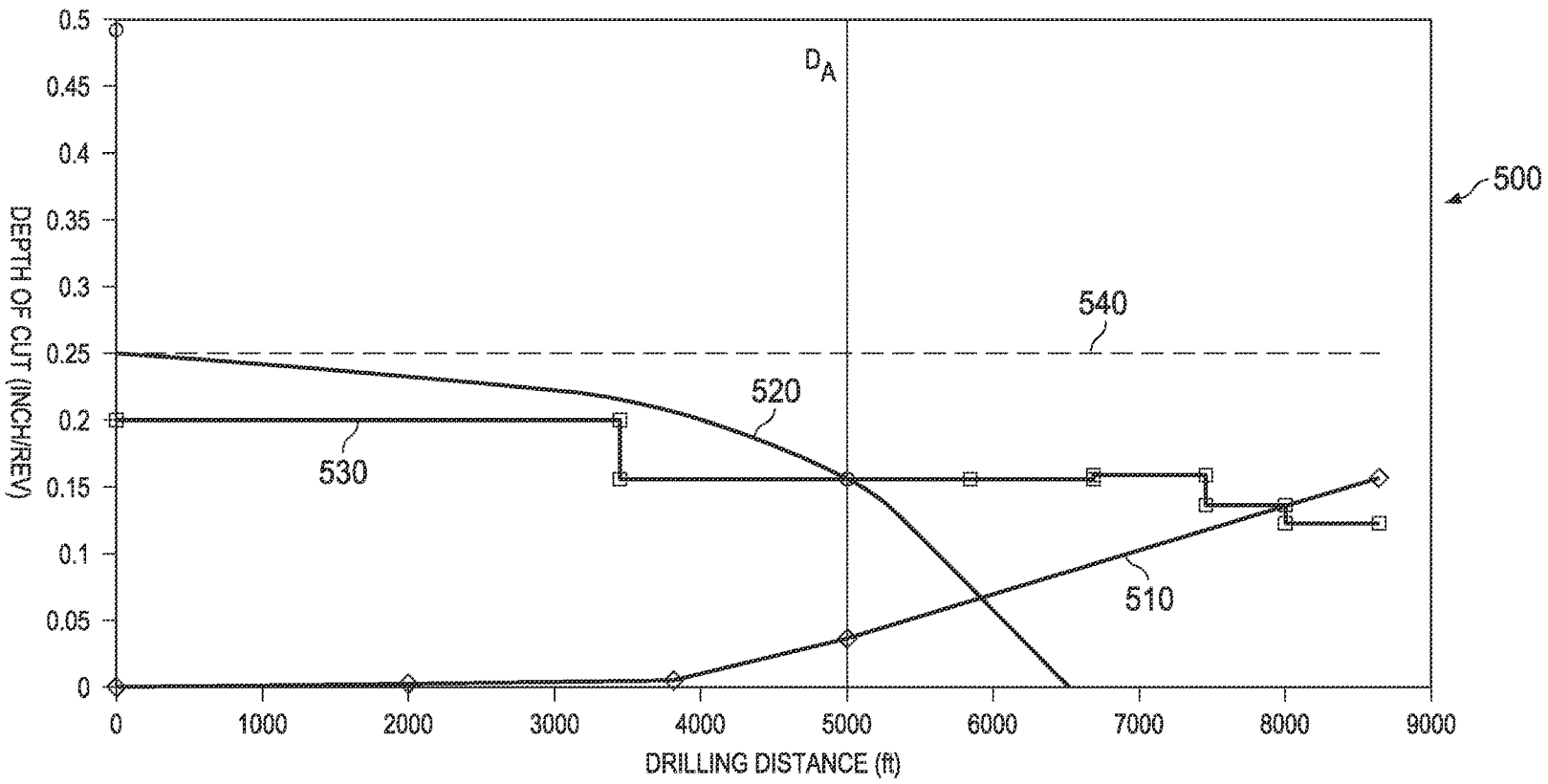
FIG. 5 illustrates a graph of first layer cutting element wear depth, second layer cutting element critical depth of cut, and actual depth of cut as a function of drilling depth, in accordance with some embodiments of the present disclosure.

FIG. 5 illustrates exemplary graph 500 of first layer cutting element wear depth, second layer cutting element critical depth of cut, and actual depth of cut for an example drill bit as a function of drilling depth, in accordance with some embodiments of the present disclosure. Critical depth of cut is a measure of the depth that second layer cutting elements cut into the formation during each rotation of drill bit 101. Actual depth of cut is the measure of the actual depth that first layer cutting elements cut into the formation during each rotation of drill bit 101. As first layer cutting elements become worn (and actual depth of cut decreases), the second layer cutting elements critical depth of cut may decrease such that second layer cutting elements engage the formation at a particular drilling distance. Based on run information 300 gathered as illustrated in FIG. 3, the actual wear of cutting elements may be plotted and then an average wear line may be estimated. Cutting element wear as a function of drilling depth may be shown as plot 510. According to some embodiments of the present disclosure, a prediction of cutting element wear from drilling information may be made by utilizing a cutting element wear model, such as a model generated using SPARTA™ analytical tools designed and manufactured by Halliburton Energy Services, Inc. (Houston, Tex.). The cutting element wear models may be used to determine the cutting element wear of any drill bit, including drill bit 101. One such model may be based on the accumulated work done by drill bit 101:

$$\text{Wear (\%)}=(\text{Cumwork}/\text{BitMaxWork})^{a}*100\%$$

where

Cumwork=f(drilling depth); and a=wear exponent and is between approximately 0.5 and 5.0.

Using the above model, cutting element wear as a function of drilling depth for a drill bit may be estimated and utilized during downhole drilling. Once the wear characteristics are obtained from the model, the drilling depth at which the first layer cutting elements may be worn to the point that the second layer cutting elements begin to cut into the formation ($D_A$) may be determined. For example, as illustrated in cutting element wear plot 510 in FIG. 5, after drilling to a depth of approximately 5,000 feet, the first layer cutting elements may have a cutting element wear depth of approximately 0.04 inches. Cutting element wear plot 510 in FIG. 5 may depend on the material properties of the PDC layer and the bit operational parameters. As illustrated below with reference to FIGS. 6A-7, cutting element wear plot 510 may play a role in the optimization of the layout of the second layer cutting elements.

Second layer cutting element critical depth of cut as a function of drilling depth may be shown by plot 520 and actual depth of cut as a function of drilling depth may be shown by plot 530. Second layer critical depth of cut if there was no first layer cutting element wear may be shown by plot 540. A comparison of second layer depth of cut and actual depth of cut may identify when second layer cutting elements may engage the formation. For example, second layer cutting elements may have an initial critical depth of cut (plot 520) that may be greater than the actual depth of cut (plot 530). At a particular drilling distance, $D_A$, second layer cutting element critical depth of cut, plot 520, may intersect with the actual depth of cut, plot 530. At a target drilling depth, second layer cutting element critical depth of cut, plot 520, may be equal to approximately zero. Actual depth of cut, plot 530, may be generated based on field measurements in accordance with FIGS. 4A and 4B.

In some embodiments, the second layer cutting elements may be under-exposed by any suitable amount such that first layer cutting elements cut into the formation from the surface to a first drilling depth ($D_A$), and the second layer cutting elements begin to cut into the formation at $D_A$ as the first layer cutting elements become worn. An analysis of FIG. 5 indicates that the second layer cutting elements may begin to cut into the formation at drilling depth $D_A$ of approximately 5,000 feet or when the actual depth of cut is approximately equivalent to the second layer critical depth of cut.

Thus, to ensure that second layer cutting elements do not cut into the formation until a particular drilling depth $D_A$, the under-exposure of second layer cutting elements may be set to provide a critical depth of cut for second layer cutting elements greater than the actual depth of cut. Further, a critical depth of cut for the second layer cutting elements as a function of the drilling distance may be obtained based on the first layer cutting element wear depth. The under-exposure of the second layer cutting elements may approximate the first layer cutting element wear depth at a target drilling distance.

Figure 6A:
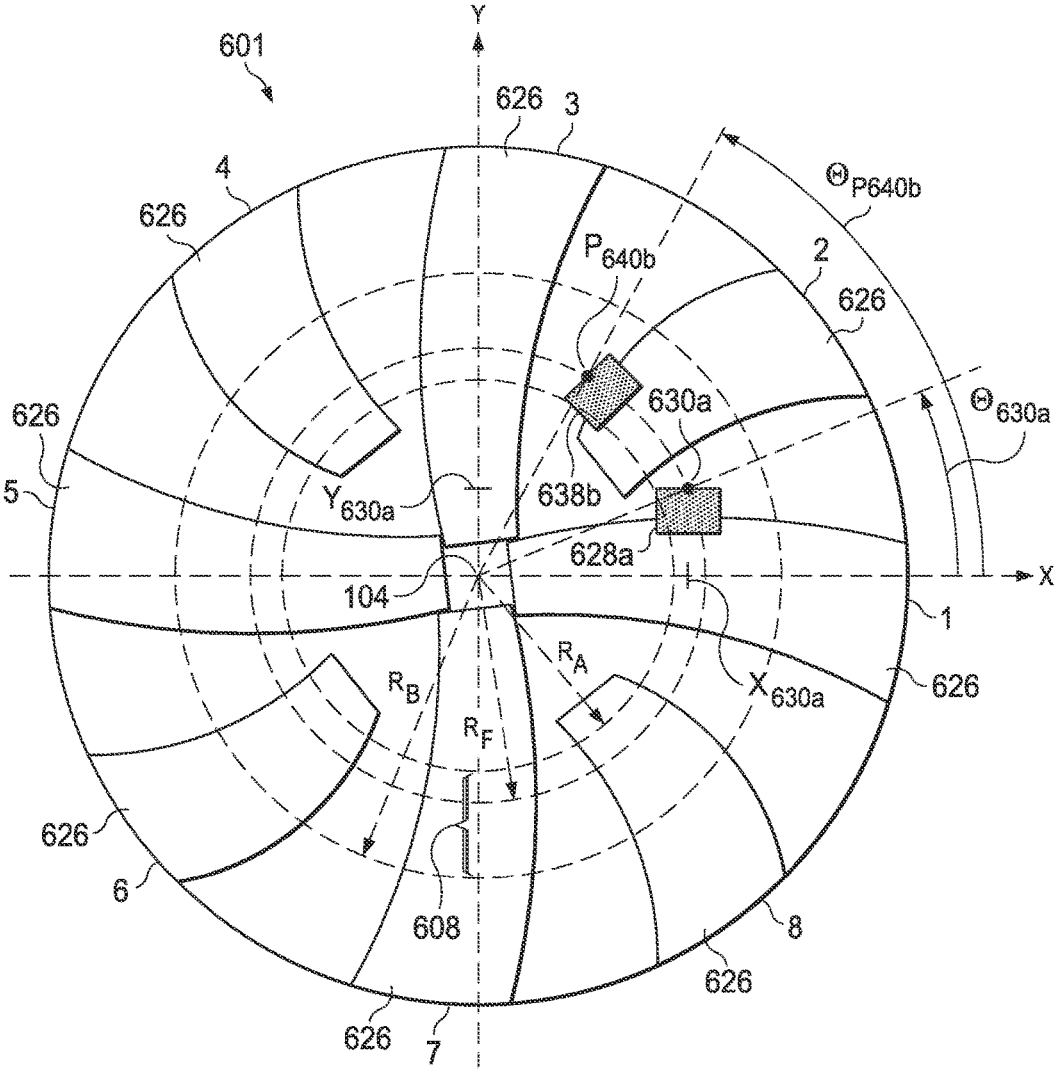
FIG. 6A illustrates a schematic drawing for a bit face of a drill bit including first layer and second layer cutting elements for which a critical depth of cut control curve (CDCCC) may be determined, in accordance with some embodiments of the present disclosure.
Figure 6B:
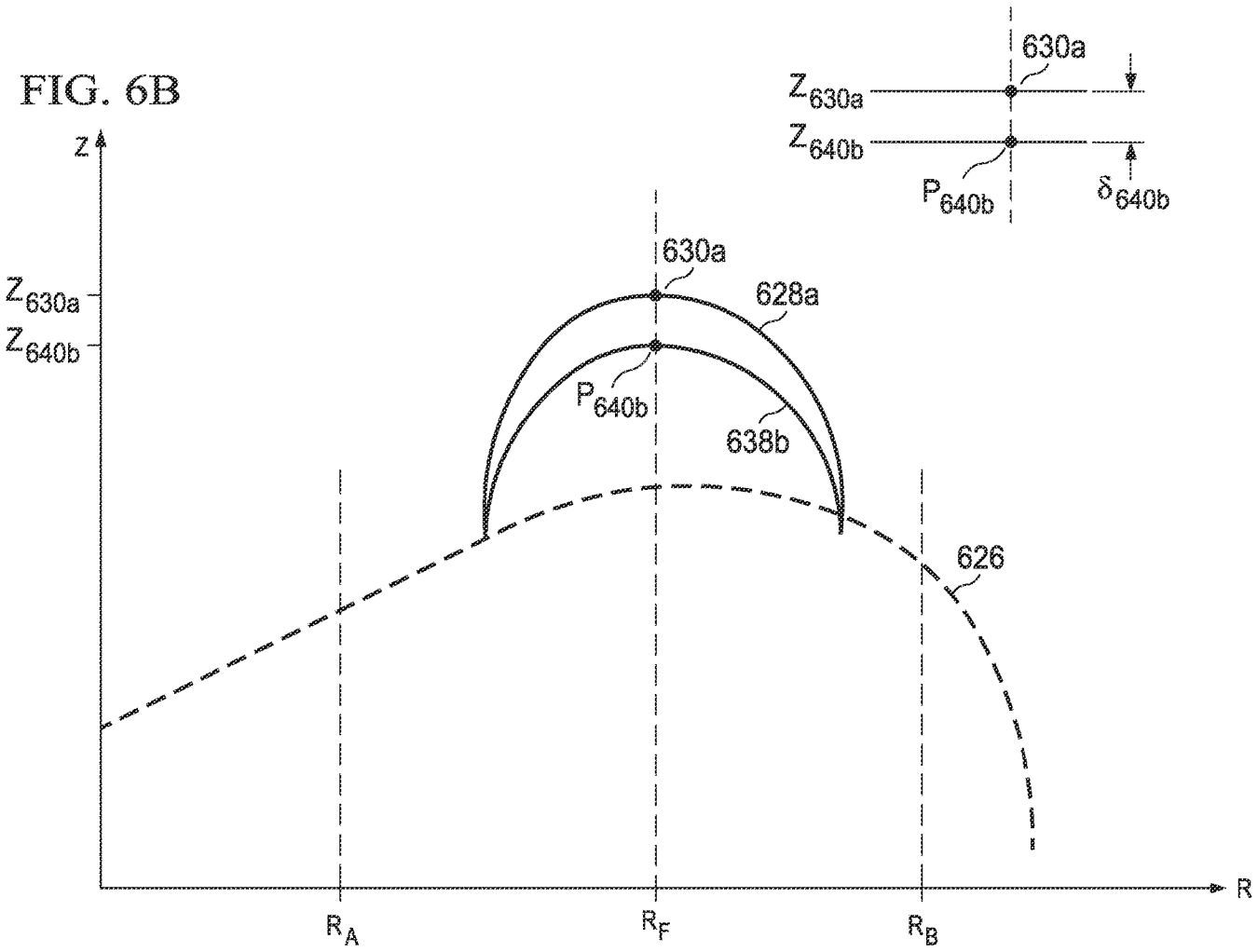
FIG. 6B illustrates a schematic drawing for a bit face profile of the drill bit of FIG. 6A, in accordance with some embodiments of the present disclosure.

Accordingly, determining the amount of wear the first layer cutting element undergoes before second layer cutting elements engage the formation may be useful. In order to determine when the second layer cutting element may begin to cut into the formation, a critical depth of cut curve (CDCCC) for PDC bits having second layer cutting elements may be determined. FIG. 6A illustrates a schematic drawing for a bit face of drill bit 601 including first layer and second layer cutting elements 628 and 638 for which a CDCCC may be determined, in accordance with some embodiments of the present disclosure. FIG. 6B illustrates a schematic drawing for a bit face profile of drill bit 601 of FIG. 6A, in accordance with some embodiments of the present disclosure. To provide a frame of reference, FIG. 6B includes a z-axis that may represent the rotational axis of drill bit 601. Accordingly, a coordinate or position corresponding to the z-axis of FIG. 6B may be referred to as an axial coordinate or axial position of the bit face profile depicted in FIG. 6B. FIG. 6B also includes a radial axis (R) that indicates the orthogonal distance from the rotational axis, of drill bit 601.

Additionally, a location along the bit face of drill bit 601 shown in FIG. 6A may be described by x and y coordinates of an xy-plane of FIG. 6A. The xy-plane of FIG. 6A may be substantially perpendicular to the z-axis of FIG. 6B such that the xy-plane of FIG. 6A may be substantially perpendicular to the rotational axis of drill bit 601. Additionally, the x-axis and y-axis of FIG. 6A may intersect each other at the z-axis of FIG. 6B such that the x-axis and y-axis may intersect each other at the rotational axis of drill bit 601.

The distance from the rotational axis of the drill bit 601 to a point in the xy-plane of the bit face of FIG. 6A may indicate the radial coordinate or radial position of the point on the bit face profile depicted in FIG. 6B. For example, the radial coordinate, r, of a point in the xy-plane having an x-coordinate, x, and a y-coordinate, y, may be expressed by the following equation:

$$r=\sqrt{x^2+y^2}.$$

Additionally, a point in the xy-plane (of FIG. 6A) may have an angular coordinate that may be an angle between a line extending orthogonally from the rotational axis of drill bit 601 to the point and the x-axis. For example, the angular coordinate (θ) of a point on the xy-plane (of FIG. 6B) having an x-coordinate, x, and a y-coordinate, y, may be expressed by the following equation:

$$\theta=\arctan(y/x).$$

As a further example, as illustrated in FIG. 6A, cutlet point 630*a* (described in further detail below) associated with a cutting edge of first layer cutting element 628*a* may have an x-coordinate ($X_{630a}$) and a y-coordinate ($Y_{630a}$) in the xy-plane. $X_{630a}$ and $Y_{630a}$ may be used to calculate a radial coordinate ($R_F$) of cutlet point 630*a* (e.g., $R_F$ may be equal to the square root of $X_{630a}$ squared plus $Y_{630a}$ squared). $R_F$ may accordingly indicate an orthogonal distance of cutlet point 630*a* from the rotational axis of drill bit 601.

Additionally, cutlet point 630*a* may have an angular coordinate ($\theta_{630a}$) that may be the angle between the x-axis and the line extending orthogonally from the rotational axis of drill bit 601 to cutlet point 630*a* (e.g., $\theta_{630a}$ may be equal to arctan ($X_{630a}/Y_{630a}$)). Further, as depicted in FIG. 6B, cutlet point 630*a* may have an axial coordinate ($Z_{630a}$) that may represent a position of cutlet point 630*a* along the rotational axis of drill bit 601.

The cited coordinates and coordinate systems are used for illustrative purposes only, and any other suitable coordinate system or configuration, may be used to provide a frame of reference of points along the bit face profile and bit face of a drill bit associated with FIGS. 6A and 6B, without departing from the scope of the present disclosure. Additionally, any suitable units may be used. For example, the angular position may be expressed in degrees or in radians.

Returning to FIG. 6A, drill bit 601 may include a plurality of blades 626 that may include cutting elements 628 and 638. For example, FIG. 6A depicts an eight-bladed drill bit 601 in which blades 626 may be numbered 1-8. However, drill bit 601 may include more or fewer blades than shown in FIG. 6A. Cutting elements 628 and 638 may be designated as either first layer cutting elements 628 or second layer cutting elements 638. Each cutting element 628 or 638 may be referred to with an ending character, e.g., a-h, that corresponds to the blade, e.g., 1-8, on which the particular cutting element is located. For example, first layer cutting element 628*a* may be located on blade 1. As another example, second layer cutting element 638*b* may be located on blade 2. Second layer cutting elements 638 may be utilized to extend the life of drill bit 601 as first layer cutting elements 628 become worn. Second layer cutting elements 638 may be placed to overlap a radial swath of first layer cutting elements 628. In other words, second layer cutting elements 638 may be located at the same radial position as associated first layer cutting elements 628 (e.g., second layer cutting elements 638 may be track set with respect to first layer cutting elements 628). Track set cutting elements have radial correspondence such that they are at the same radial position with respect to bit rotational axis 104. Additionally, in some designs for drill bit 601, second layer cutting elements 638 may not be configured to overlap the rotational path of first layer cutting elements 628. Single set cutting elements may each have a unique radial position with respect to bit rotational axis 104. FIG. 6A illustrates an example of a track set configuration in which first layer cutting elements 628*a* and second layer cutting elements 638*b* are located at the same radial distance from rotational axis 104.

The critical depth of cut of drill bit 601 may be the point at which second layer cutting elements 638*b* begin to cut into the formation. Accordingly, the critical depth of cut of drill bit 601 may be determined for a radial location along drill bit 601. For example, drill bit 601 may include a radial coordinate $R_F$ that may intersect with the cutting edge of second layer cutting element 638*b* at control point $P_{640b}$. Likewise, radial coordinate $R_F$ may intersect with the cutting edge of first layer cutting element 628*a* at cutlet point 630*a*.

The angular coordinates of cutlet point 630*a* ($\theta_{630a}$) and control point $P_{640b}$ ($\theta_{P640b}$) may be determined. A critical depth of cut provided by control point $P_{640b}$ with respect to cutlet point 630*a* may be determined. The critical depth of cut provided by control point $P_{640b}$ may be based on the under-exposure ($\delta_{640b}$ depicted in FIG. 6B) of control point $P_{640b}$ with respect to cutlet point 630*a* and the angular coordinates of control point $P_{640b}$ with respect to cutlet point 630*a*.

For example, the depth of cut at which second layer cutting element 638*b* at control point $P_{640b}$ may begin to cut formation may be determined using the angular coordinates of cutlet point 630*a* and control point $P_{640b}$ ($\theta_{630a}$ and $\theta_{P640b}$, respectively), which are depicted in FIG. 6A. Additionally, $\Delta_{630a}$ may be based on the axial under-exposure ($\delta_{640b}$) of the axial coordinate of control point $P_{640b}$ ($Z_{P640b}$) with respect to the axial coordinate of cutlet point 630*a* ($Z_{630a}$), as depicted in FIG. 6B. In some embodiments, $\Delta_{630a}$ may be determined using the following equations:

$$\Delta_{630a}=\delta_{640b}*360/(360-(\theta_{P640b}-\theta_{630a}));\text{ and}$$

$$\delta_{640b}=Z_{630a}-Z_{P640b}.$$

In the first of the above equations, $\theta_{P640b}$ and $\theta_{630a}$ may be expressed in degrees and "360" may represent a full rotation about the face of drill bit 601. Therefore, in instances where $\theta_{P640b}$ and $\theta_{630a}$ are expressed in radians, the numbers "360" in the first of the above equations may be changed to "2 π." Further, in the above equation, the resultant angle of "($\theta_{P640b}$ and $\theta_{630a}$)" ($\Delta_\theta$) may be defined as always being positive. Therefore, if resultant angle $\Delta_\theta$ is negative, then $\Delta_\theta$ may be made positive by adding 360 degrees (or 2 π radians) to $\Delta_\theta$. Similar equations may be used to determine the depth of cut at which second layer cutting element 638*a* at control point $P_{640b}$ ($\Delta_{630a}$) may begin to cut formation in place of first layer cutting element 628*a*.

The critical depth of cut provided by control point $P_{640b}$ ($\Delta_{P640b}$) may be based on additional cutlet points along $R_F$ (not expressly shown). For example, the critical depth of cut provided by control point $P_{640b}$ ($\Delta_{P640b}$) may be based the maximum of $\Delta_{630a}$, $\Delta_{630c}$, $\Delta_{630e}$, and $\Delta_{630g}$ and may be expressed by the following equation:

$$\Delta_{P640b}=\max[\Delta_{630a},\Delta_{630c},\Delta_{630e},\Delta_{630g}].$$

Similarly, the critical depth of cut provided by additional control points (not expressly shown) at radial coordinate $R_F$ may be similarly determined. For example, the overall critical depth of cut of drill bit 601 at radial coordinate $R_F$ ($\Delta_{RF}$) may be based on the minimum of $\Delta_{P640b}$, $\Delta_{P640d}$, $\Delta_{P640f}$, and $\Delta_{P640h}$ and may be expressed by the following equation:

$$\Delta_{RF}=\min[\Delta_{P640b},\Delta_{P640d},\Delta_{P640f},\Delta_{P640h}].$$

Accordingly, the critical depth of cut of drill bit 601 at radial coordinate $R_F$ ($\Delta_{RF}$) may be determined based on the points where first layer cutting elements 628 and second layer cutting elements 638 intersect $R_F$. Although not expressly shown here, it is understood that the overall critical depth of cut of drill bit 601 at radial coordinate $R_F$ ($\Delta_{RF}$) may also be affected by control points $P_{626i}$ (not expressly shown in FIGS. 6A and 6B) that may be associated with blades 626 configured to control the depth of cut of drill bit 601 at radial coordinate $R_F$. In such instances, a critical depth of cut provided by each control point $P_{626i}$ ($\Delta_{P626i}$) may be determined. Each critical depth of cut $\Delta_{P626i}$ for each control point $P_{626i}$ may be included with critical depth of cuts $\Delta_{P626i}$ in determining the minimum critical depth of cut at $R_F$ to calculate the overall critical depth of cut $\Delta_{RF}$ at radial location $R_F$.

To determine a CDCCC of drill bit 601, the overall critical depth of cut at a series of radial locations $R_f$ ($\Delta_1$) anywhere from the center of drill bit 601 to the edge of drill bit 601 may be determined to generate a curve that represents the critical depth of cut as a function of the radius of drill bit 601. In the illustrated embodiment, second layer cutting element 638*b* may be located in radial swath 608 (shown on FIG. 6A) defined as being located between a first radial coordinate $R_A$ and a second radial coordinate $R_B$. Accordingly, the overall critical depth of cut may be determined for a series of radial coordinates $R_f$ that are within radial swath 608 and located between $R_A$ and $R_B$, as disclosed above. Once the overall critical depths of cuts for a sufficient number of radial coordinates $R_f$ are determined, the overall critical depth of cut may be graphed as a function of the radial coordinates $R_f$ as a CDCCC.

The cutting edges of first layer cutting element 628*a* may wear gradually with drilling distance. As a result the shape of cutting edges may be changed. The cutting edges of second layer cutting element 638*b* may also wear gradually with drilling distance and the shape of second layer cutting element 638*b* may also be changed. Therefore, both underexposure $\delta_{640b}$ and angle ($\theta_{P640b}-\theta_{630a}$) between cutlet point 630*a* and control point $P_{640b}$ may be changed. Thus, the critical depth of cut for a drill bit may be a function of the wear of both first layer and second layer cutting elements. At each drilling depth, a critical depth of cut for a drill bit may be estimated if wear of the cutting elements are known Modifications, additions or omissions may be made to FIGS. 6A and 6B without departing from the scope of the present disclosure. For example, as discussed above, blades 626, cutting elements 628 and 638, DOCCs (not expressly shown) or any combination thereof may affect the critical depth of cut at one or more radial coordinates and the CDCCC may be determined accordingly. Further, the above description of the CDCCC calculation may be used to determine a CDCCC of any suitable drill bit.

Figure 7A:
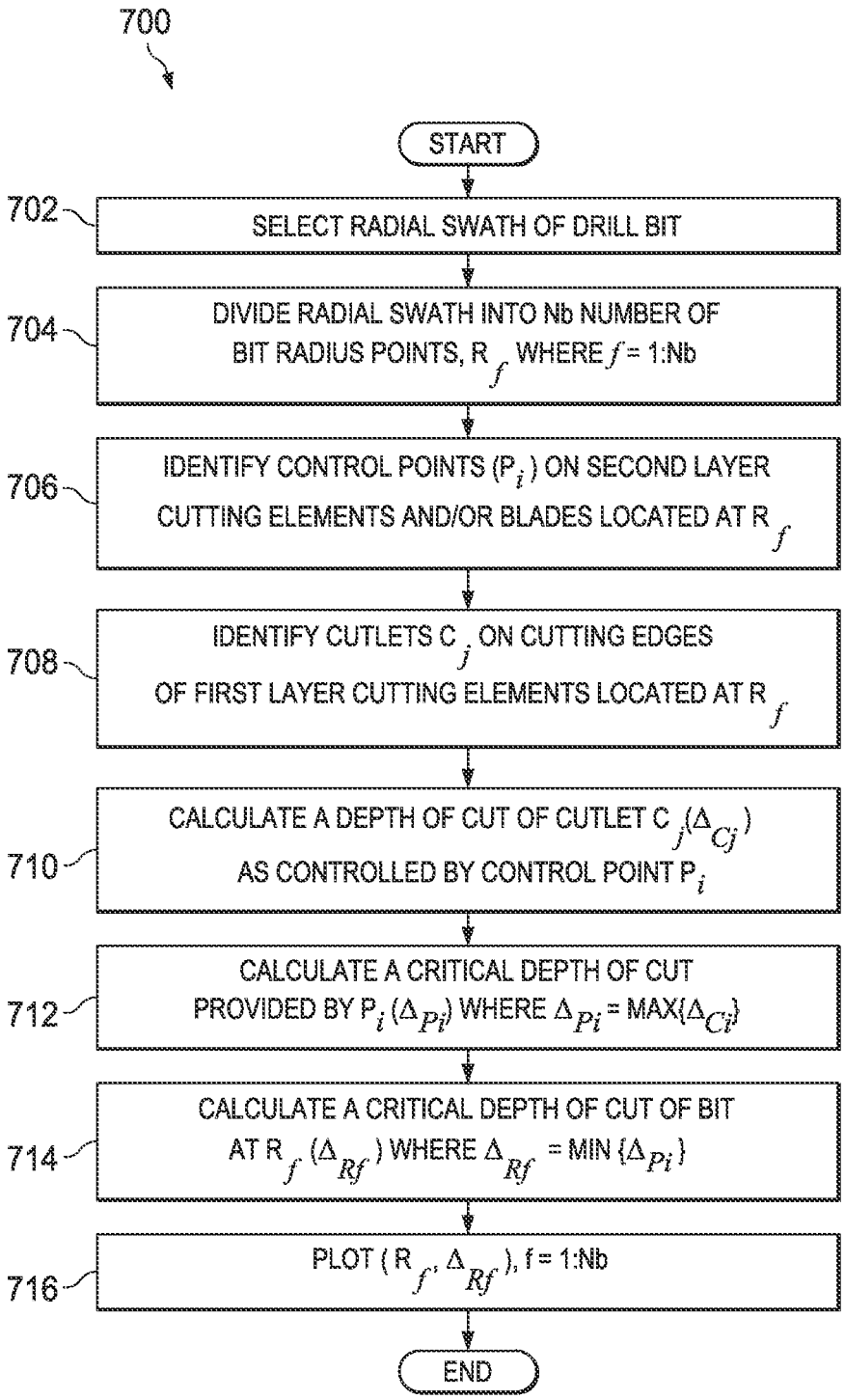
FIG. 7A illustrates a flow chart of an example method for determining and generating a CDCCC, in accordance with some embodiments of the present disclosure.

FIG. 7A illustrates a flow chart of an example method 700 for determining and generating a CDCCC in accordance with some embodiments of the present disclosure. The steps of method 700 may be performed at each specified drilling depth where cutter wear is measured or estimated. The steps of method 700 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

In the illustrated embodiment, the cutting structures of the drill bit, including at least the locations and orientations of all cutting elements and DOCCs, may have been previously designed. However in other embodiments, method 700 may include steps for designing the cutting structure of the drill bit. For illustrative purposes, method 700 is described with respect to drill bit 601 of FIGS. 6A and 6B; however, method 700 may be used to determine the CDCCC of any suitable drill bit including bits with worn cutting elements at any drilling depth.

Method 700 may start, and at step 702, the engineering tool may select a radial swath of drill bit 601 for analyzing the critical depth of cut within the selected radial swath. In some instances the selected radial swath may include the entire face of drill bit 601 and in other instances the selected radial swath may be a portion of the face of drill bit 601. For example, the engineering tool may select radial swath 608 as defined between radial coordinates $R_A$ and $R_B$ and may include second layer cutting element 638*b*, as shown in FIGS. 6A and 6B.

At step 704, the engineering tool may divide the selected radial swath (e.g., radial swath 608) into a number, Nb, of radial coordinates ($R_f$) such as radial coordinate $R_F$ described in FIGS. 6A and 6B. For example, radial swath 608 may be divided into nine radial coordinates such that Nb for radial swath 608 may be equal to nine. The variable "f" may represent a number from one to Nb for each radial coordinate within the radial swath. For example, "$R_1$" may represent the radial coordinate of the inside edge of a radial swath. Accordingly, for radial swath 608, "$R_1$" may be approximately equal to $R_A$. As a further example, "$R_{Nb}$" may represent the radial coordinate of the outside edge of a radial swath. Therefore, for radial swath 608, "$R_{Nb}$" may be approximately equal to $R_B$.

At step 706, the engineering tool may select a radial coordinate $R_f$ and may identify control points ($P_i$) at the selected radial coordinate $R_f$ and associated with a DOCC, a cutting element, and/or a blade. For example, the engineering tool may select radial coordinate $R_F$ and may identify control point $P_{640b}$ associated with second layer cutting element 638*b* and located at radial coordinate $R_F$, as described above with respect to FIGS. 6A and 6B.

At step 708, for the radial coordinate $R_f$ selected in step 706, the engineering tool may identify cutlet points ($C_j$) each located at the selected radial coordinate $R_f$ and associated with the cutting edges of cutting elements. For example, the engineering tool may identify cutlet point 630*a* located at radial coordinate $R_F$ and associated with the cutting edges of first layer cutting element 628*a* as described and shown with respect to FIGS. 6A and 6B.

At step 710 the engineering tool may select a control point $P_i$ and may calculate a depth of cut for each cutlet point $C_j$ as controlled by the selected control point $P_i$ ($\Delta_{Cj}$). For example, the engineering tool may determine the depth of cut of cutlet point 630*a* as controlled by control point $P_{640b}$ ($\Delta_{630a}$) by using the following equations:

$$\Delta_{630a}=\delta_{640b}*360/(360-(\theta_{640b}-\theta_{630a}));\text{ and}$$

$$\delta_{640b}=Z_{630a}-Z_{P640b}.$$

At step 712, the engineering tool may calculate the critical depth of cut provided by the selected control point ($\Delta_{Pi}$) by determining the maximum value of the depths of cut of the cutlet points $C_j$ as controlled by the selected control point $P_i$ ($\Delta_{Cj}$) and calculated in step 710. This determination may be expressed by the following equation:

$$\Delta_{Pi}=\max\{\Delta_{Cj}\}.$$

For example, control point $P_{340a}$ may be selected in step 710 and the depths of cut for cutlet point 630*a*, 630*c*, 630*e*, and 630*g* (not expressly shown) as controlled by control point $P_{640b}$ ($\Delta_{630a}$, $\Delta_{630c}$, $\Delta_{630e}$, and $\Delta_{630g}$, respectively) may also be determined in step 710, as shown above. Accordingly, the critical depth of cut provided by control point $P_{640b}$ ($\Delta_{P640b}$) may be calculated at step 712 using the following equation:

$$\Delta_{P640b}=\max[\Delta_{630a},\Delta_{630c},\Delta_{630e},\Delta_{630g}].$$

The engineering tool may repeat steps 710 and 712 for all of the control points $P_i$ identified in step 706 to determine the critical depth of cut provided by all control points $P_i$ located at radial coordinate $R_f$ For example, the engineering tool may perform steps 710 and 712 with respect to control points $P_{640c}$, $P_{640e}$, and $P_{640g}$ (not expressly shown) to determine the critical depth of cut provided by control points $P_{640c}$, $P_{640e}$, and $P_{640g}$ with respect to cutlet points 630*a*, 630*c*, 630*e*, and 630*g* (not expressly shown) at radial coordinate $R_F$ shown in FIGS. 6A and 6B.

At step 714, the engineering tool may calculate an overall critical depth of cut at the radial coordinate $R_f$ ($\Delta_1$) selected in step 706. The engineering tool may calculate the overall critical depth of cut at the selected radial coordinate $R_f$ ($\Delta_f$) by determining a minimum value of the critical depths of cut of control points $P_i$ ($\Delta_{Pi}$) determined in steps 710 and 712. This determination may be expressed by the following equation:

$$\Delta_{Rf}=\min\{\Delta_{Pi}\}.$$

For example, the engineering tool may determine the overall critical depth of cut at radial coordinate $R_F$ of FIGS. 6A and 6B by using the following equation:

$$\Delta_{RF}=\min[\Delta_{P640b},\Delta_{P640d},\Delta_{P640f},\Delta_{P640h}].$$

The engineering tool may repeat steps 706 through 714 to determine the overall critical depth of cut at all the radial coordinates $R_f$ generated at step 704.

At step 716, the engineering tool may plot the overall critical depth of cut ($\Delta_{Rf}$) for each radial coordinate $R_f$, as a function of each radial coordinate $R_f$. Accordingly, a CDCCC may be calculated and plotted for the radial swath associated with the radial coordinates $R_f$ For example, the engineering tool may plot the overall critical depth of cut for each radial coordinate $R_f$ located within radial swath 608, such that the CDCCC for swath 608 may be determined and plotted, as depicted in FIG. 5. Following step 716, method 700 may end. Accordingly, method 700 may be used to calculate and plot a CDCCC of a drill bit. The CDCCC may be used to determine whether the drill bit provides a substantially even control of the depth of cut of the drill bit. Therefore, the critical CDCCC may be used to modify the DOCCs, second layer cutting elements, and/or blades of the drill bit configured to control the depth of cut of the drill bit or configured to cut into the formation when first layer cutting elements are sufficiently worn in order to maximize drilling efficiency and bit life.

Method 700 may be repeated at any specified drilling depth where cutting element wear may be estimated or measured. The minimum of the CDCCC at each specified drilling depth may represent the critical depth of cut of the drill bit. Additionally, modifications, additions, or omissions may be made to method 700 without departing from the scope of the present disclosure. For example, the order of the steps may be performed in a different manner than that described and some steps may be performed at the same time. Additionally, each individual step may include additional steps without departing from the scope of the present disclosure.

Figure 7B:
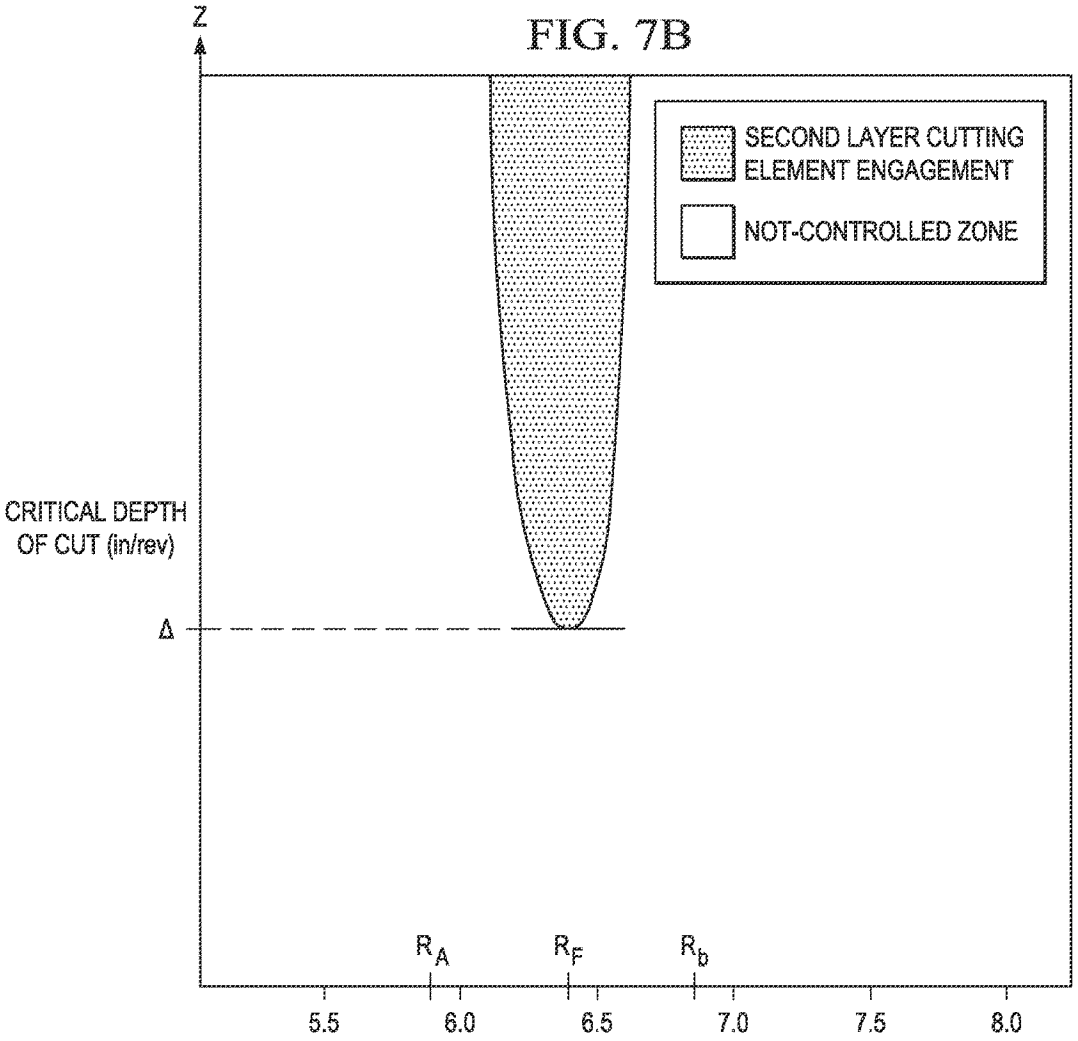
FIG. 7B illustrates a graph of a CDCCC where the critical depth of cut is plotted as a function of the bit radius of the drill bit of FIG. 6A, in accordance with some embodiments of the present disclosure.

Accordingly, FIG. 7B illustrates a graph of a CDCCC where the critical depth of cut is plotted as a function of the bit radius of drill bit 601 of FIG. 6A, in accordance with some embodiments of the present disclosure. As mentioned above, a CDCCC may be used to determine the minimum critical depth of cut control as provided by the second layer cutting elements and/or blades of a drill bit. For example, FIG. 7B illustrates a CDCCC for drill bit 601 between radial coordinates $R_A$ and $R_B$. The z-axis in FIG. 7B may represent the critical depth of cut along the rotational axis of drill bit 601, and the radial (R) axis may represent the radial distance from the rotational axis of drill bit 601. For example, at a given under-exposure $\delta_{640b}$ for second layer cutting element 638*b* and control points $P_{640b}$ of approximately 0.03 inches and a configuration shown in FIG. 6A (e.g., when second layer cutting element 638*b* is one blade 626 in front of first layer cutting element 628*a*), the critical depth of cut $\Delta_{630a}$ is approximately 0.03246 in/rev.

The equation detailed above for critical depth of cut for first layer cutting elements 628*i* with cutlet points 630*i* may be rewritten more generally as:

$$\Delta_{630i}=\delta_{640i}*360/(360-(\theta_{P640i}-\theta_{630i}));\text{ and}$$

$$\delta_{640i}=Z_{630}-Z_{P640i}.$$

If the angular locations of cutlet points 630*i* ($\theta_{630i}$) are fixed, then critical depth of cut, $\Delta_{630i}$, becomes a function of two variables: under-exposure of second layer cutting elements at control points $P_{640i}$ ($\delta_{640i}$) and angular location of second layer cutting elements at control points $P_{640i}$ ($\theta_{P640i}$). Thus, the equation for critical depth of cut, $\Delta_{630i}$, may be rewritten as:

$$\Delta_{630i}=\delta_{640i}*f(\theta_{P640i}).$$

The first variable, under-exposure of second layer cutting elements at control point $P_{640i}$ ($\delta_{640i}$), may be determined by the wear depth of first layer cutting elements 628. Thus, an estimate of the wear depth of first layer cutting elements 628 may be determined as a function of drilling depth.

Additionally, the second variable, $f(\theta_{P640i})$, may be written as:

$$f(\theta_{P640i})=360/(360-(\theta_{P640i}-\theta_{630i})).$$

Further, $(\theta_{P640i}-\theta_{630i})$ may vary from approximately 10 to 350 degrees for most drill bits. Thus, $f(\theta_{P640i})$ may vary from approximately 1.0286 to approximately 36. The above analysis illustrates that $f(\theta_{P640i})$ may act as an amplifier to critical depth of cut $\Delta_{630i}$. Therefore, for a given under-exposure $\delta_{640i}$, it may be possible to choose an angular location to meet a required critical depth of cut $\Delta_{630i}$.

FIGS. 8A-8I illustrate schematic drawings of bit faces of drill bit 801 with exemplary placements for second layer cutting elements 838, in accordance with some embodiments of the present disclosure. For purposes of this disclosure, blades 826 may be numbered 1-*n* based on the blade configuration. For example, FIGS. 8A-8I depict eight-bladed drill bits 801*a*-801*i* and blades 826 may be numbered 1-8. However, drill bit 801*a*-801*i* may include more or fewer blades than shown in FIGS. 8A-8I without departing from the scope of the present disclosure. For an eight-bladed drill bit, blades 1, 3, 5 and 7 may be primary blades, and 2, 4, 6 and 8 may be secondary blades. Thus, there may be four possible blades 826 for placement of second layer cutting elements 838 in accordance with some embodiments of the present disclosure. Selection of the configuration of drill bit 801 may be based on the characteristics of the formation to be drilled and corresponding configuration of second layer cutting elements, e.g., under-exposure and/or blade location (as discussed below with reference to Table 1).

In FIGS. 8A-8D, first layer cutting element 828*a* with cutlet point 830*a* may be located on blade 1 and first layer cutting element 828*c* may be located on blade 3. Cutting elements 828*a* and 828*c* may be single set.

Figure 8A:
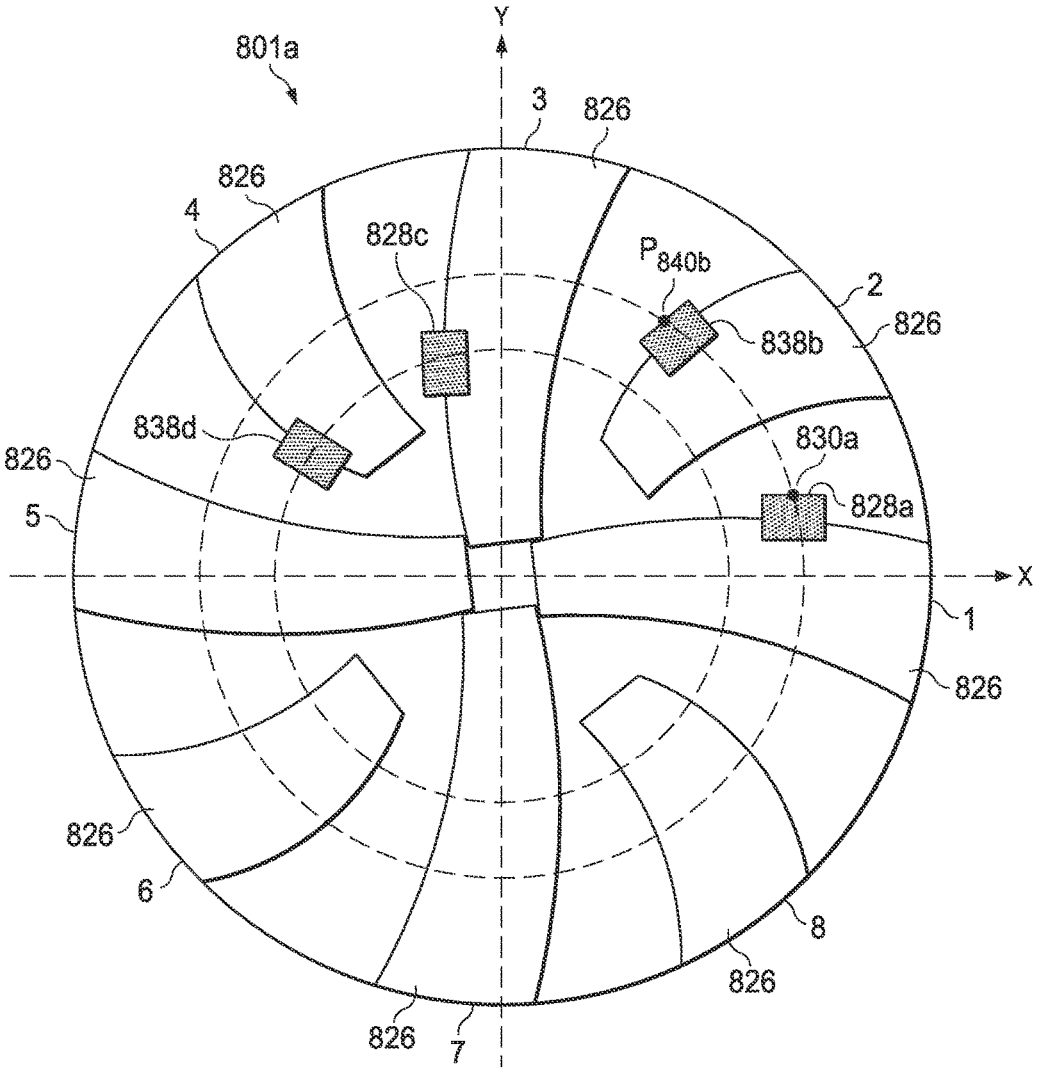
FIGS. 8A-8I illustrate schematic drawings of bit faces of a drill bit with exemplary placements for second layer cutting elements, in accordance with some embodiments of the present disclosure.

FIG. 8A illustrates second layer cutting element 838*b* and control point $P_{840b}$ located on blade 2 of drill bit 801*a* such that second layer cutting element 838*b* may be track set with first layer cutting element 828*a*. Second layer cutting element 838*d* may be located on blade 4 and may be track set with first layer cutting element 828*c*. Because second layer cutting elements are located on the blade rotationally in front of the corresponding first layer cutting element, drill bit 801*a* may be described as front track set.

Figure 8B:
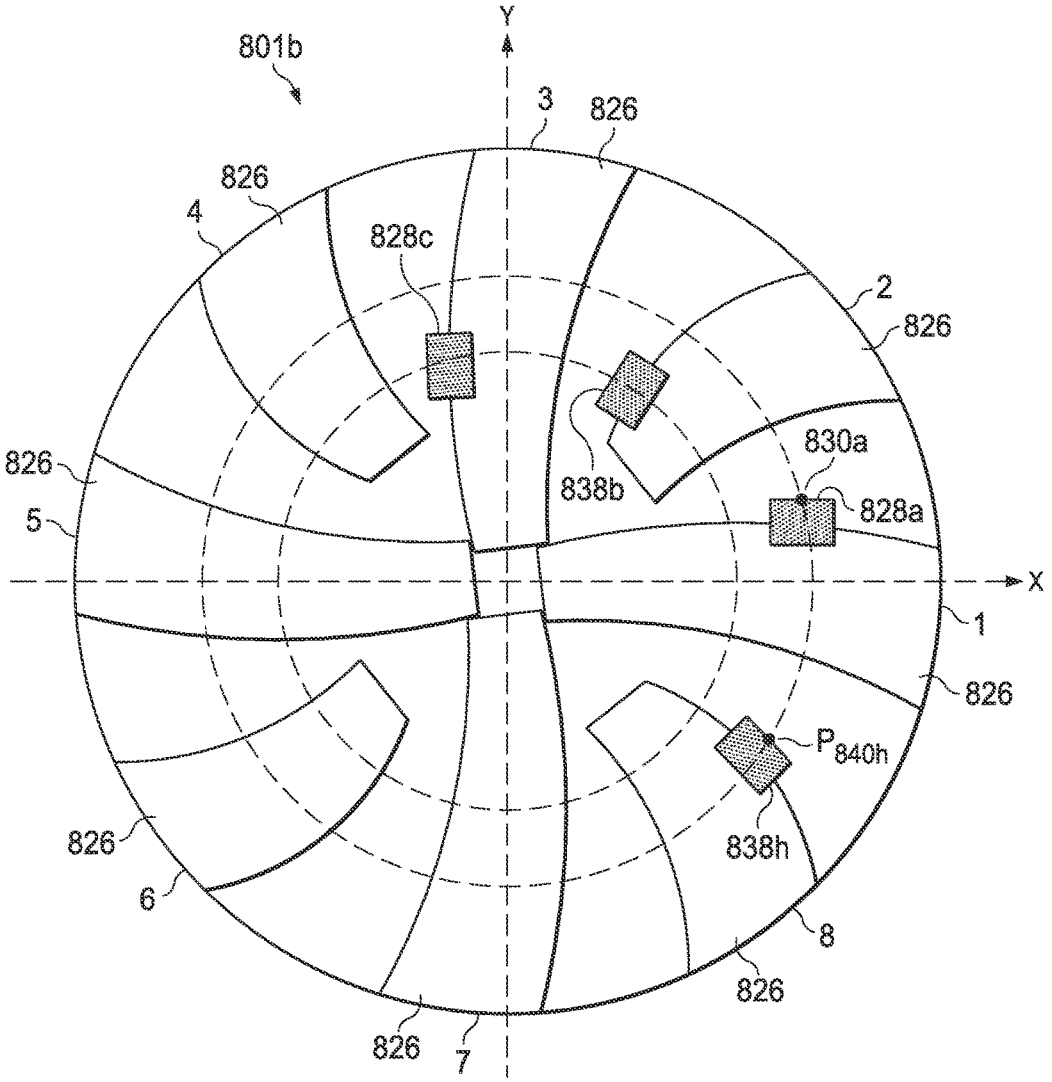

FIG. 8B illustrates second layer cutting element 838*h* and control point $P_{840h}$ located on blade 8 of drill bit 801*b* such that second layer cutting element 838*h* may be track set with first layer cutting element 828*a*. Second layer cutting element 838*b* may be located on blade 2 and may be track set with first layer cutting element 828*c*. Because second layer cutting elements are located on the blade rotationally behind the corresponding first layer cutting element, drill bit 801*b* may be described as behind track set.

Figure 8C:
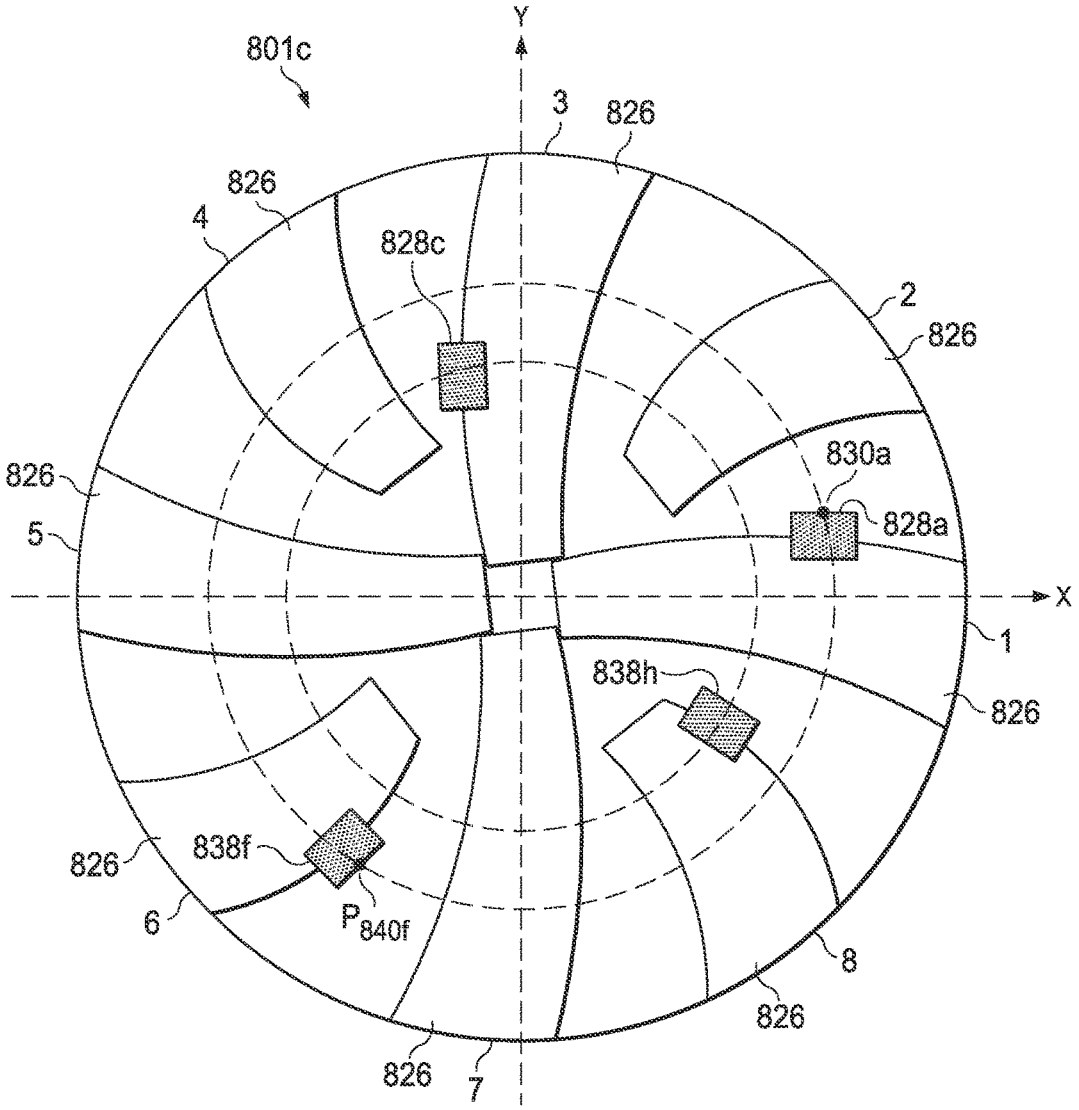

FIG. 8C illustrates second layer cutting element 838*f* and control point $P_{840f}$ located on blade 6 of drill bit 801*c* such that second layer cutting element 838*f* may be track set with first layer cutting element 828*a*. Second layer cutting element 838*h* may be located on blade 8 and may be track set with first layer cutting element 828*c*.

Figure 8D:
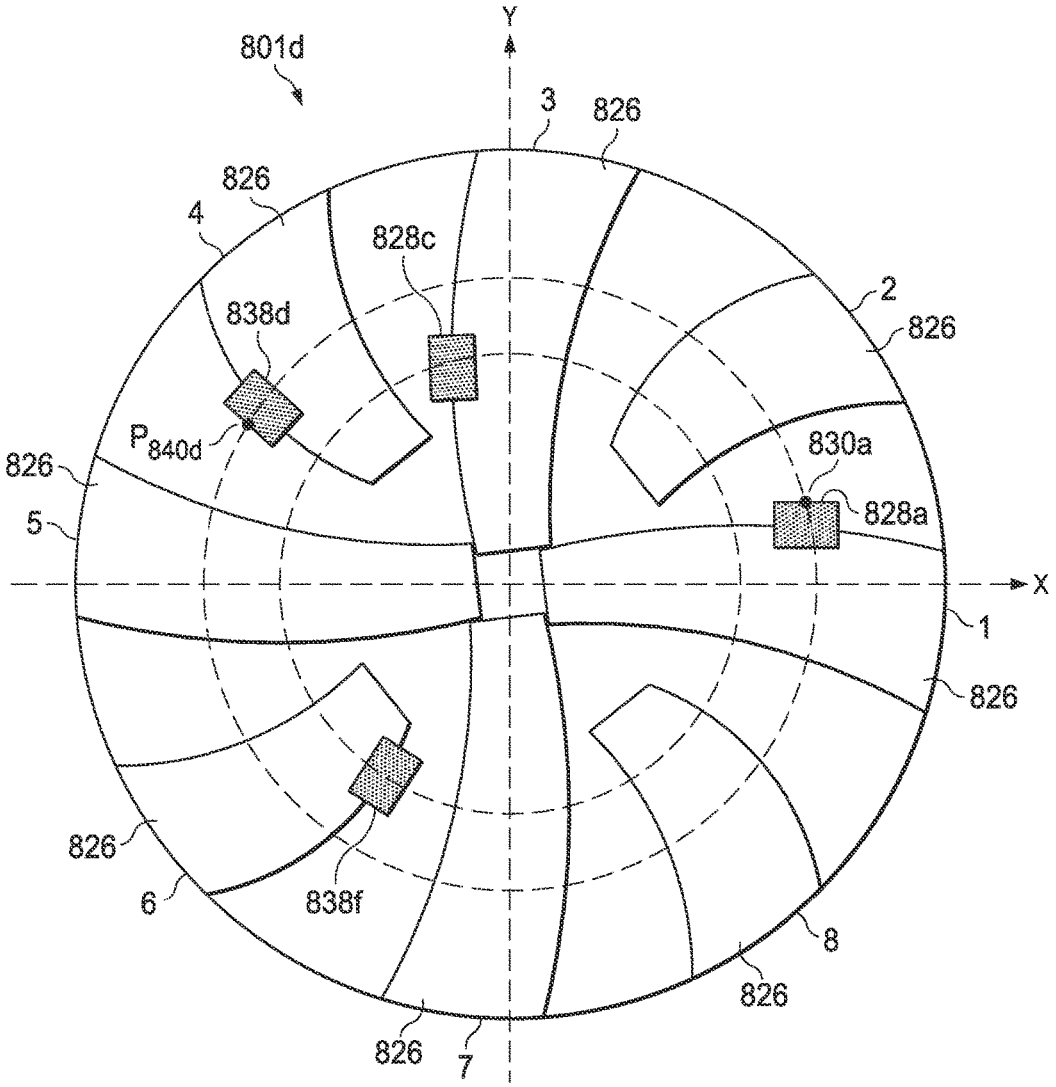

FIG. 8D illustrates second layer cutting element 838*d* and control point $P_{840d}$ located on blade 4 of drill bit 801*d* such that second layer cutting element 838*d* may be track set with first layer cutting element 828*a*. Second layer cutting element 838*f* may be located on blade 6 and may be track set with first layer cutting element 828*c*.

Figure 8E:
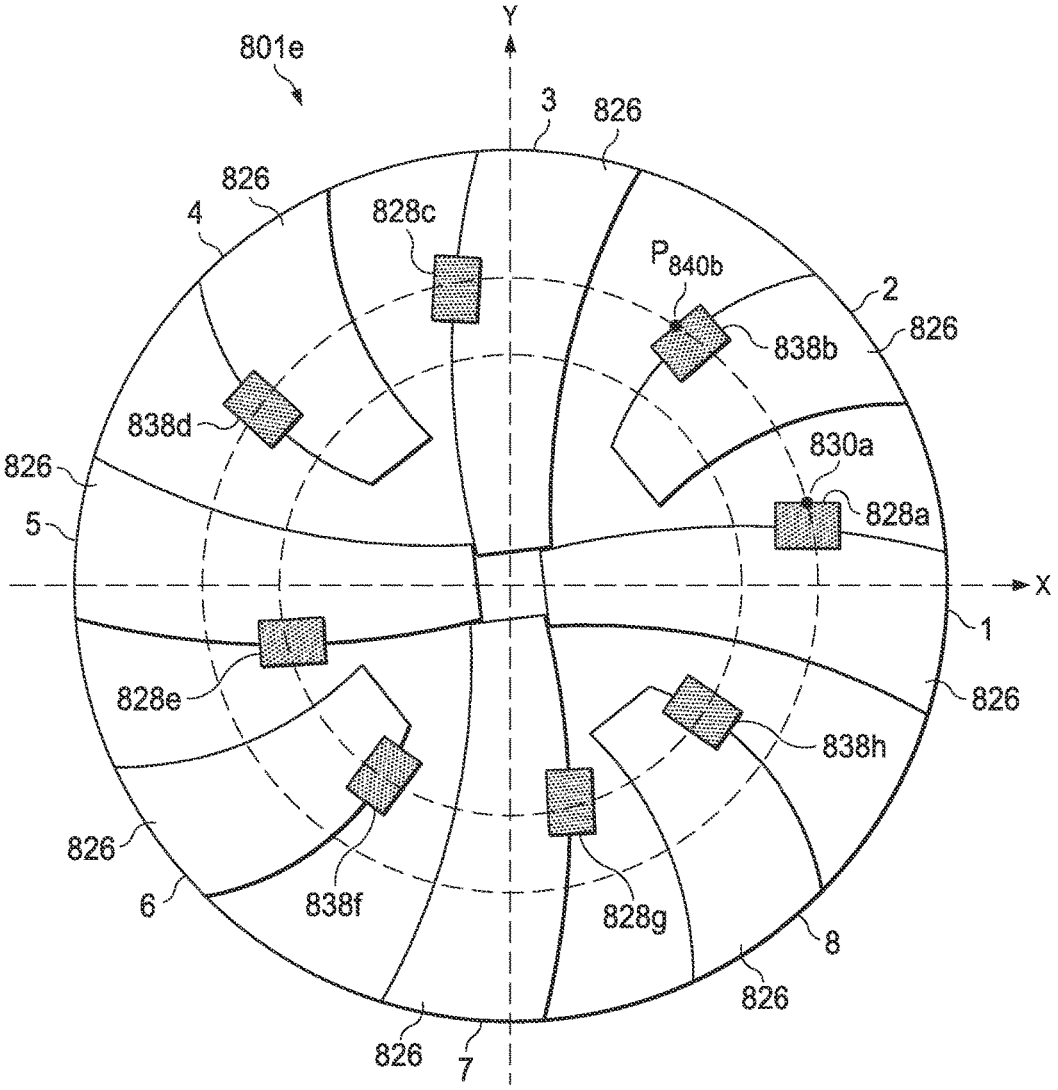

In FIG. 8E, first layer cutting element 828*a* with cutlet point 830*a* may be located on blade 1 of drill bit 801*e* and first layer cutting element 828*c* may be located on blade 3 such that cutting element 828*c* may be track set with first layer cutting element 828*a*. First layer cutting elements 828*e* and 828*g* located on blades 5 and 7, respectively, may also be track set. Second layer cutting elements 838*b* and 838*d*, located on blades 2 and 4, respectively, may be track set with first layer cutting elements 828*a* and 828*c*. Second layer cutting elements 838*f* and 838*h*, located on blades 6 and 8, respectively, may be track set with first layer cutting elements 828*e* and 828*g*. Second layer cutting element 838*b* may include control point $P_{840b}$. As such, cutting elements on blades 1-4 may be track set (more specifically, front track set), and cutting elements on blades 5-8 may be track set.

Figure 8F:
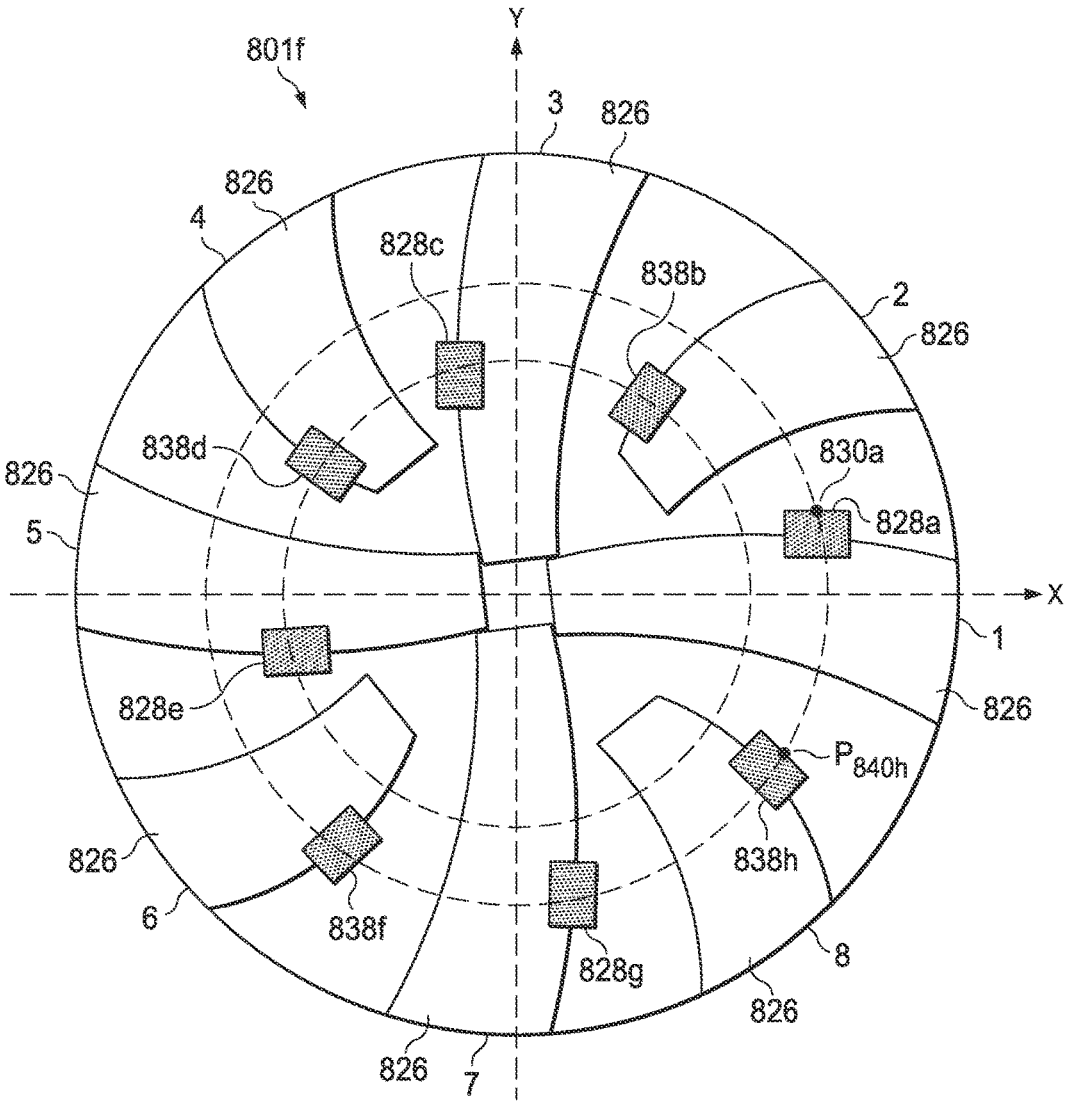

In FIG. 8F, first layer cutting element 828*a* with cutlet point 830*a* may be located on blade 1 of drill bit 801*f*. First layer cutting element 828*g* may be located on blade 7 and may be track set with first layer cutting element 828*a*. First layer cutting elements 828*c* and 828*e* located on blades 3 and 5, respectively, may also be track set. Second layer cutting elements 838*f* and 838*h*, located on blades 6 and 8, respectively, may be track set with first layer cutting elements 828*a* and 828*g*. Second layer cutting elements 838*b* and 838*d*, located on blades 2 and 4, respectively, may be track set with first layer cutting elements 828*c* and 828*e*. Second layer cutting element 838*h* may include control point $P_{840h}$. As such, cutting elements on blades 2-5 may be track set (more specifically, back track set), and cutting elements on blades 1 and 6-8 may be track set.

Figure 8G:
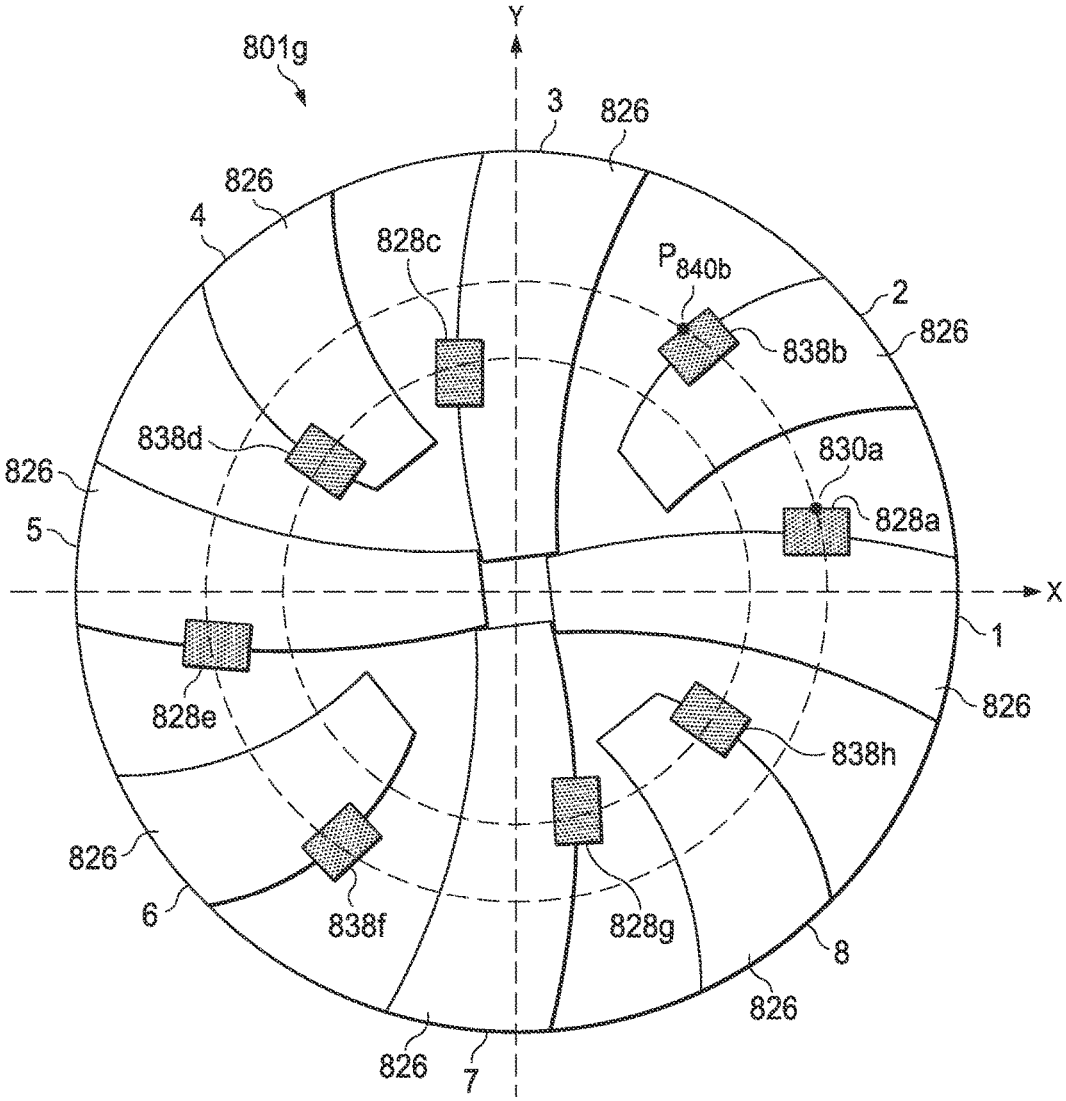

FIG. 8G illustrates first layer cutting element 828*a* with cutlet point 830*a* located on blade 1 of drill bit 801*g*. First layer cutting element 828*e* may be located on blade 5 and may be track set with first layer cutting element 828*a*. First layer cutting elements 828*c* and 828*g* located on blades 3 and 7, respectively, may also be track set. Second layer cutting elements 838*b* and 838*f*, located on blades 2 and 6, respectively, may be track set with first layer cutting elements 828*a* and 828*e*. Second layer cutting elements 838*d* and 838*h*, located on blades 4 and 8, respectively, may be track set with first layer cutting elements 828*c* and 828*g*. Second layer cutting element 838*b* may include control point $P_{840b}$. As such, cutting elements on blades 1, 2, 5 and 6 may be track set, and cutting elements on blades 3, 4, 7, and 8 may be track set.

Figure 8H:
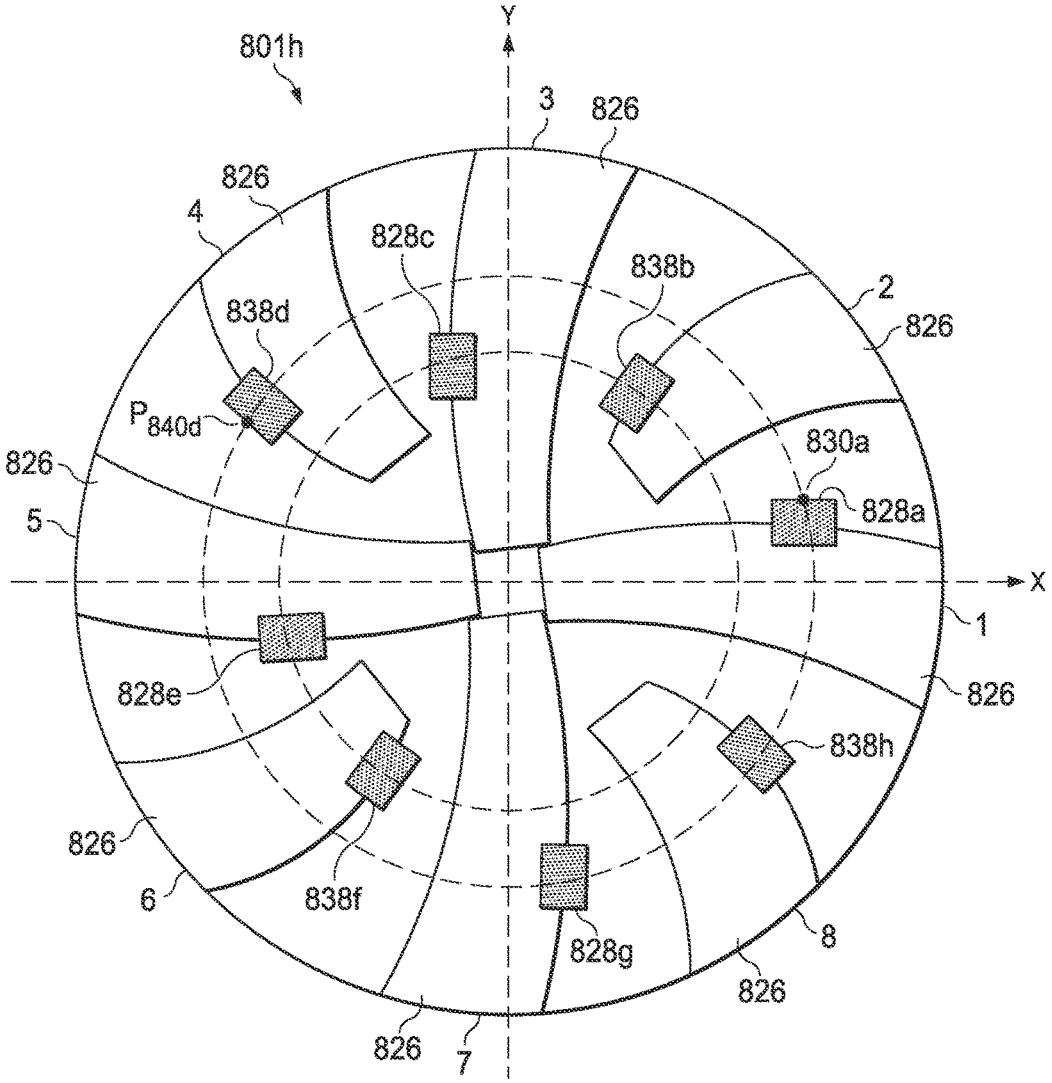

FIG. 8H illustrates first layer cutting element 828*a* with cutlet point 830*a* located on blade 1 of drill bit 801*h*. First layer cutting element 828*g* may be located on blade 7 and may be track set with first layer cutting element 828*a*. First layer cutting elements 828*c* and 828*e* located on blades 3 and 5, respectively, may also be track set. Second layer cutting elements 838*d* and 838*h*, located on blades 4 and 8, respectively, may be track set with first layer cutting elements 828*a* and 828*g*. Second layer cutting elements 838*b* and 838*f*, located on blades 2 and 6, respectively, may be track set with first layer cutting elements 828*c* and 828*e*. Second layer cutting element 838*d* may include control point $P_{840d}$. As such, cutting elements on blades 1, 4, 7 and 8 may be track set, and cutting elements on blades 2, 3, 5, 6 may be track set.

Figure 8I:
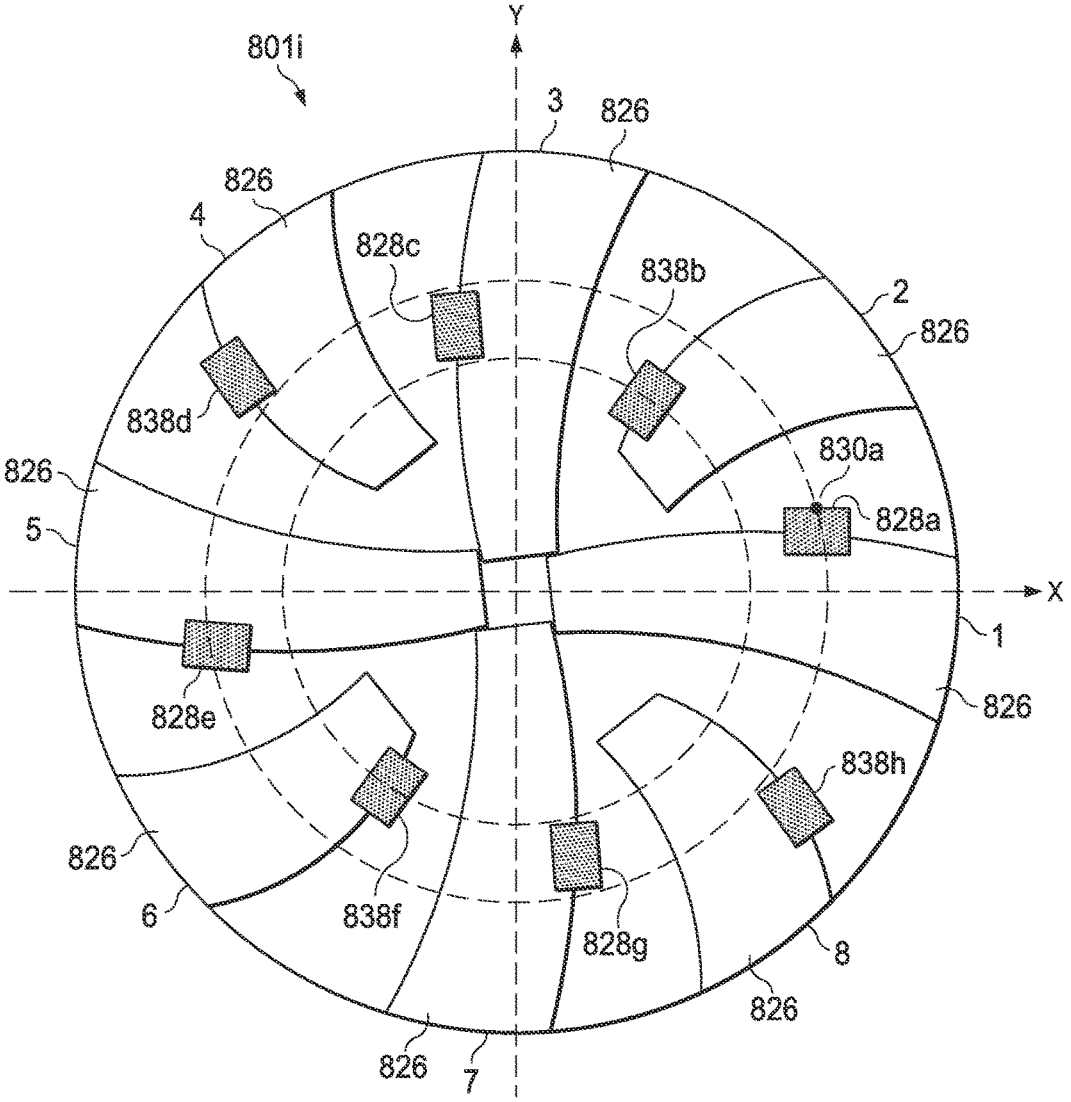

FIG. 8I illustrates first layer cutting element 828*a* with cutlet point 830*a* located on blade 1 of drill bit 801*i*. First layer cutting element 828*e* may be located on blade 5 and may be track set with first layer cutting element 828*a*. First layer cutting elements 828*c* and 828*g* located on blades 3 and 7, respectively, may also be track set. Second layer cutting elements 838*b* and 838*f*, located on blades 2 and 6, respectively, may be track set. Second layer cutting elements 838*d* and 838*h*, located on blades 4 and 8, respectively, may be track set.

For each of the angular locations of second layer cutting elements 838 shown in FIGS. 8A-8I and a given under-exposure $\delta_{840i}$, critical depth of cut $\Delta_{830i}$ may be calculated using method 700 shown in FIG. 7A or any other suitable method. Further, for a given critical depth of cut $\Delta_{830i}$, under-exposure $\delta_{840i}$ of second layer cutting elements 838 may be varied so that each of second layer cutting elements 838 engage the formation substantially simultaneously.

Figure 9:
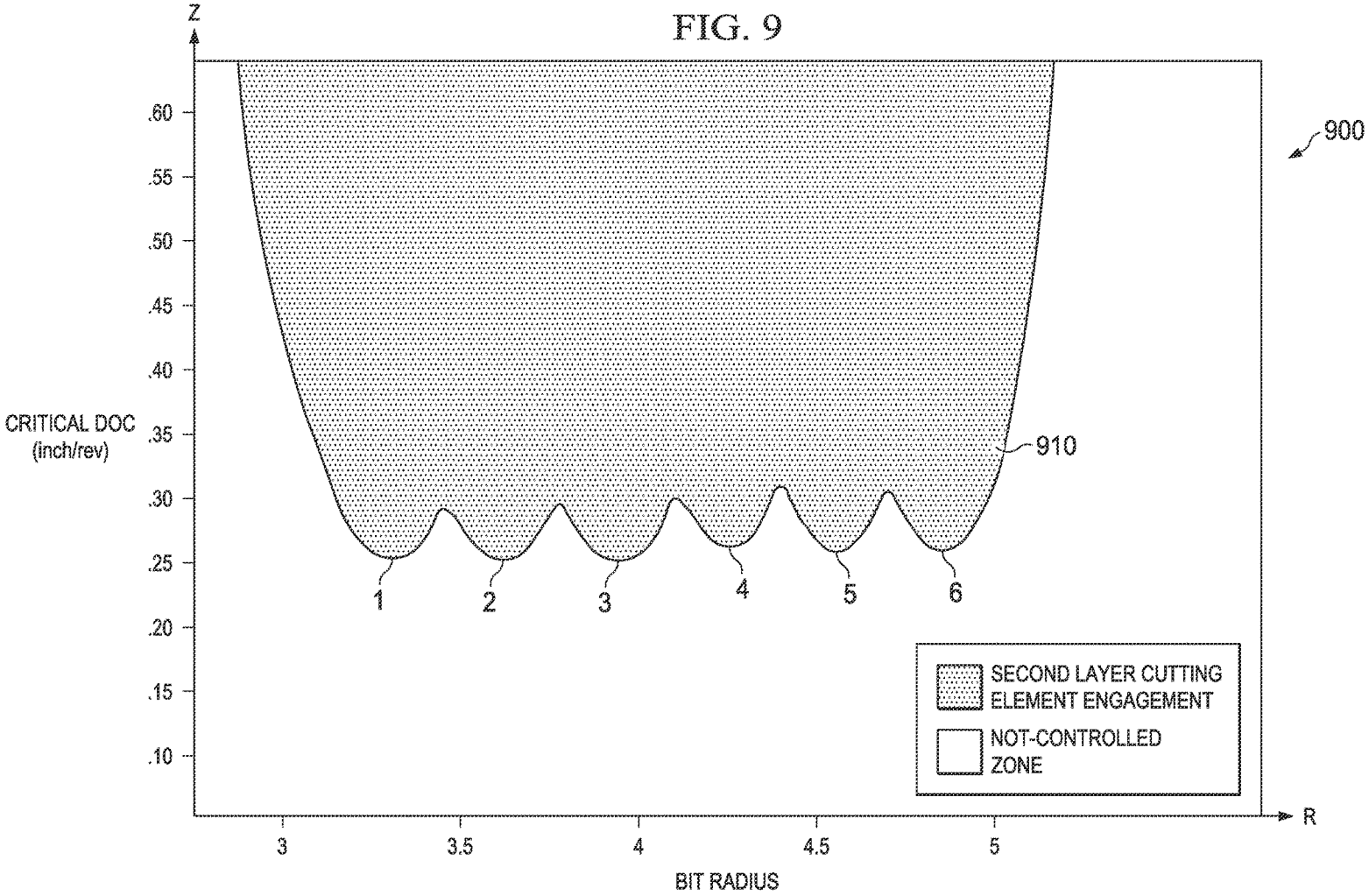
FIG. 9 illustrates a graph of a CDCCC where the critical depth of cut is plotted as a function of the bit radius for a bit where the second layer cutting elements have different under-exposures, in accordance with some embodiments of the present disclosure.

FIG. 9 illustrates graph 900 of CDCCC 910 where the critical depth of cut is plotted as a function of the bit radius for a bit where the second layer cutting elements have different under-exposures, in accordance with some embodiments of the present disclosure. In the illustrated embodiment, CDCCC 910 is generated for a drill bit configured with six second layer cutting elements track set with corresponding first layer cutting elements. The under-exposure of each of second layer cutting elements may be adjusted such that a target critical depth of cut may be achieved. For example, a target critical depth of cut may be specified as approximately 0.25 in/rev. In the illustrated embodiment, the under-exposure of each of second layer cutting elements 838, which may be numbered 1-6 extending out from a bit rotational axis, may be adjusted such that each second layer cutting element 1-6 begins to cut into the formation at approximately 0.25 in/rev.

Figure 10:
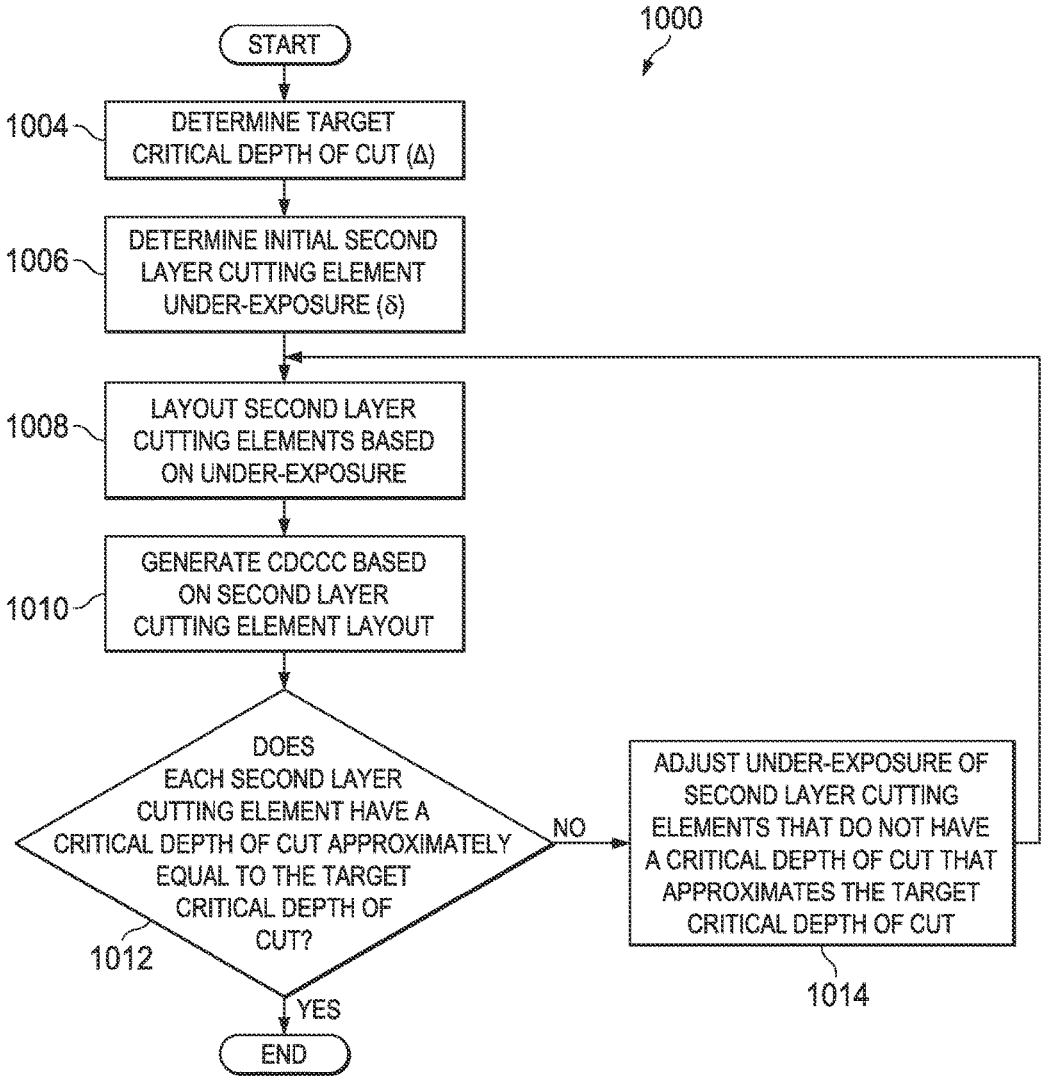
FIG. 10 illustrates a flowchart of an example method for adjusting under-exposure of second layer cutting elements on a drill bit to approximate a target critical depth of cut, in accordance with some embodiments of the present disclosure.

FIG. 10 illustrates a flow chart of example method 1000 for adjusting under-exposure of second layer cutting elements to approximate a target critical depth of cut, in accordance with some embodiments of the present disclosure. The steps of method 1000 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

In the illustrated embodiment, the cutting structures of the drill bit, including at least the locations and orientations of all cutting elements and DOCCs, may have been previously designed. However in other embodiments, method 1000 may include steps for designing the cutting structure of the drill bit. For illustrative purposes, method 1000 is described with respect to drill bit 801*a* illustrated in FIG. 8A; however, method 1000 may be used to determine appropriate under-exposures of second layer cutting elements of any suitable drill bit.

Method 1000 may start, and at step 1004, the engineering tool may determine a target critical depth of cut (Δ). The target may be based on formation characteristics, prior drill bit design and simulations, a CDCCC generated using method 700 shown in FIG. 7, or obtained from any other suitable method. For example, the engineering tool may determine a target critical depth of cut (Δ) of approximately 0.25 inches based on formation strength.

At step 1006, the engineering tool may determine an initial under-exposure (δ) for second layer cutting elements. Initial under-exposure may be generated based on an existing drill bit design, formation characteristics, or any other suitable parameter. For example, initial under-exposure δ, for drill bit 801*a* may be defined as approximately 0.01 inches.

At step 1008, the engineering tool may layout second layer cutting elements based on the initial under-exposure and a predetermined blade configuration. For example, drill bit 801*a* may have second layer cutting elements 838*b* configured on blade 2 and first layer cutting elements 828*a* configured on blade 1 as illustrated in FIG. 8A. Second layer cutting elements may be track set with corresponding first layer cutting elements and under-exposed approximately 0.01 inches.

At step 1010, the engineering tool may generate a CDCCC based on the initial second layer cutting element layout generated at step 1008. The CDCCC may be generated based on method 700 shown in FIG. 7 or any other suitable method.

At step 1012, the engineering tool may analyze the CDCCC for each second layer cutting element and determine if the critical depth of cut for each second layer cutting element approximates the target critical depth of cut obtained in step 1004. For example, at an initial given under-exposure of approximately 0.01 inches for the first second layer cutting elements, the critical depth of cut may be less than 0.25 in/rev. If a target critical depth of cut is approximately 0.25 in/rev, the under-exposure of the first second layer cutting element may be adjusted. Step 1012 may be repeated for all second layer cutting elements.

If all second layer cutting elements have a critical depth of cut that approximates the target critical depth of cut from step 1004, the method ends. If any second layer cutting elements do not have a critical depth of cut that approximates the target critical depth of cut from step 1004, then the method continues to step 1014.

At step 1014, the engineering tool may adjust the under-exposure of any second layer cutting elements that did not have a critical depth of cut that approximated the target critical depth of cut obtained in step 1004. The process then returns to step 1008 until each of the second layer cutting elements achieves a critical depth of cut that approximates the target critical depth of cut obtained in step 1014. For example, the under-exposure for each second layer cutting element 1-6 may be adjusted in order to approximate a target critical depth of cut of 0.25 inches.

Modifications, additions, or omissions may be made to method 1400 without departing from the scope of the present disclosure. For example, the order of the steps may be performed in a different manner than that described and some steps may be performed at the same time. Additionally, each individual step may include additional steps without departing from the scope of the present disclosure.

Table 1 illustrates example under-exposures for simulations performed for each of the drill bit 801 configurations illustrated in FIGS. 8A-8I. The values in Table 1 are based on a given critical depth of cut equal to approximately 0.25 in/rev. The under-exposures of each of multiple second layer cutting elements were varied for each drill bit 801*a*-801*i* configuration shown in FIGS. 8A-8I. The under-exposures in inches were ranked from minimum to maximum and the average under-exposure was calculated.

| Drill bit | Minimum under-exposure (inches) | Maximum under-exposure (inches) | Average under-exposure (inches) |
|---|---|---|---|
| 801a | 0.0775 | 0.1787 | 0.1426 |
| 801b | 0.0313 | 0.0537 | 0.0410 |
| 801c | 0.0627 | 0.1106 | 0.0868 |
| 801d | 0.0775 | 0.1699 | 0.1350 |
| 801e | 0.0313 | 0.1669 | 0.1012 |
| 801f | 0.0313 | 0.520 | 0.0411 |
| 801g | 0.0981 | 0.1071 | 0.1017 |
| 801h | 0.0313 | 0.1664 | 0.0770 |
| 801i | 0.0768 | 0.1421 | 0.1205 |

For example, the average under-exposure for drill bit 801*a* shown in FIG. 8A, in which the second layer cutting elements are positioned on blades rotationally in front of corresponding first layer cutting elements, may be approximately 0.1426 inches. As another example, the average under-exposure for drill bit 801*b* shown in FIG. 8B, in which the second layer cutting elements are positioned on blades rotationally behind corresponding first layer cutting elements, may be approximately 0.0410 inches. Accordingly, the under-exposure for each second layer cutting element may be adjusted to achieve a critical depth of cut at which the second layer cutting elements may begin to cut into a formation. In other embodiments, the second layer cutting elements may be under-exposed by any suitable amount such that first layer cutting elements cut into the formation from a start point to a first drilling depth ($D_A$); the second layer cutting elements begin to partially cut into the formation at $D_A$; and the second layer cutting elements cut efficiently, as discussed with reference to FIG. 5.

In some applications, multiple bits may be utilized to drill a wellbore with multiple types of formations. For example, a drill bit with four blades may be utilized to drill into a first formation down to a particular depth. The four bladed drill bit may drill at approximately 120 RPM and a ROP of approximately 120 ft/hr. When the four bladed drill bit reaches a second formation, the cutting elements may be worn to a depth of approximately 0.025 inches. A different bit with eight blades may be utilized to drill into the second formation. In order to minimize the need to change from a four bladed to an eight bladed drill bit, a drill bit with eight blades may be designed to drill through both the first formation and the second formation. For example, first layer cutting elements, e.g., located on blades 1, 3, 5 and 7 shown with reference to FIGS. 8A-8I, may be designed to cut into the first and second formations. Second layer cutting elements, e.g., located on blades 2, 4, 6 and 8, may be designed to not contact the first formation and begin cutting when the drill bit reaches the second formation. For instance, second layer cutting elements may be designed to not cut under drilling conditions of approximately 120 RPM and ROP of approximately 120 ft/hr. Thus, second layer cutting elements may have a CDOC, Δ, of approximately 0.20 in/rev (120 ft/hr/(5*120 RPM)). Further, second layer cutting elements may have an under-exposure, δ, that is greater than approximately 0.025 inches, e.g., the wear depth of the first layer cutting elements when contacting the second formation.

In some embodiments, simulations may be conducted based on design parameters to determine a drill bit configuration, e.g., drill bits 801*a*-801*i* of FIGS. 8A-8I, that meets the drilling requirements. For example, IBitS™ design software designed and manufactured by Halliburton Energy Services, Inc. (Houston, Tex.) may be utilized. For example, a behind track set configuration as shown in FIG. 8B may be selected for simulation. Selection of a drill bit configuration may be based on past simulation results, field results, calculated parameters, and/or any other suitable criteria. For example, selection of back track set drill bit configuration may be based on the average under-exposure shown in Table 1, above, with reference to drill bit 801*b*. Parameters relating to the design may be input into the simulation software. A simulated layout may be generated and a determination may be made if the simulation meets the drilling requirements. For example, a simulation may be run with second layer cutting elements CDOC of approximately 0.20 in/rev, an RPM of approximately 120, and an ROP of approximately 120 ft/hr. The simulation may show that the second layer cutting elements under-exposure, δ, may be approximately 0.025 inches-0.040 inches. Thus, with a behind track set configuration, when first layer cutting elements are worn to between approximately 0.025 inches-0.040 inches, second layer cutting elements may begin to cut the formation.

As another example, a formation may exist that is relatively soft and abrasive. When drilling into a soft and abrasive formation, a drill bit with few blades, e.g., a four bladed drill bit, may be effective. An abrasive formation may wear cutting elements at a greater rate than a non-abrasive formation. Thus, when the cutting elements on a four bladed drill bit become worn, the drill bit may not drill as efficiently, e.g., experience a higher MSE. For example, cutting elements drilling into a formation at approximately 120 RPM and an ROP of approximately 90 ft/hr may have a wear depth of approximately 0.1 inches at a particular first drilling depth. Below the first drilling depth, a new four bladed drill bit may be utilized. In some embodiments, use of two layers of cutting elements on an eight bladed drill bit may improve the efficiency of a drill bit drilling into a soft and abrasive formation. For example, first layer cutting elements, e.g., located on blades 1, 3, 5 and 7 shown with reference to FIGS. 8A-8I, may be designed to cut into the formation. Second layer cutting elements, e.g., located on blades 2, 4, 6 and 8, may be designed to not contact the formation until a first drilling depth is reached. At that drilling depth, second layer cutting elements may begin cutting into the formation. For instance, second layer cutting elements may be designed to not cut under drilling conditions of approximately 120 RPM and ROP of approximately 90 ft/hr. Thus, second layer cutting elements may have a CDOC, Δ, of approximately 0.15 in/rev (90 ft/hr/(5*120 RPM)). Further, second layer cutting elements may have an under-exposure, δ, that is greater than approximately 0.1 inches, e.g., the wear depth of the first layer cutting elements when reaching the first drilling depth.

In some embodiments, a front track set configuration as shown in FIG. 8A may be selected for simulation. Selection of a drill bit configuration may be based on past simulation results, field results, calculated parameters, and/or any other suitable criteria. For example, selection of front track set drill bit configuration may be based on the average under-exposure shown in Table 1, above, with reference to drill bit 801*a*. Parameters relating to the design may be input into the simulation software. A simulated layout may be generated and a determination may be made if the simulation meets the drilling requirements. For example, a simulation may be run with second layer cutting elements CDOC of approximately 0.15 in/rev. The simulation may show that the second layer cutting elements under-exposure, δ, may be approximately 0.085 inches-0.127 inches, with an average of approximately 0.109 inches. Thus, with a front track set configuration, when first layer cutting elements are worn to average approximately 0.109 inches, second layer cutting elements may begin to cut the formation.

Figure 11:
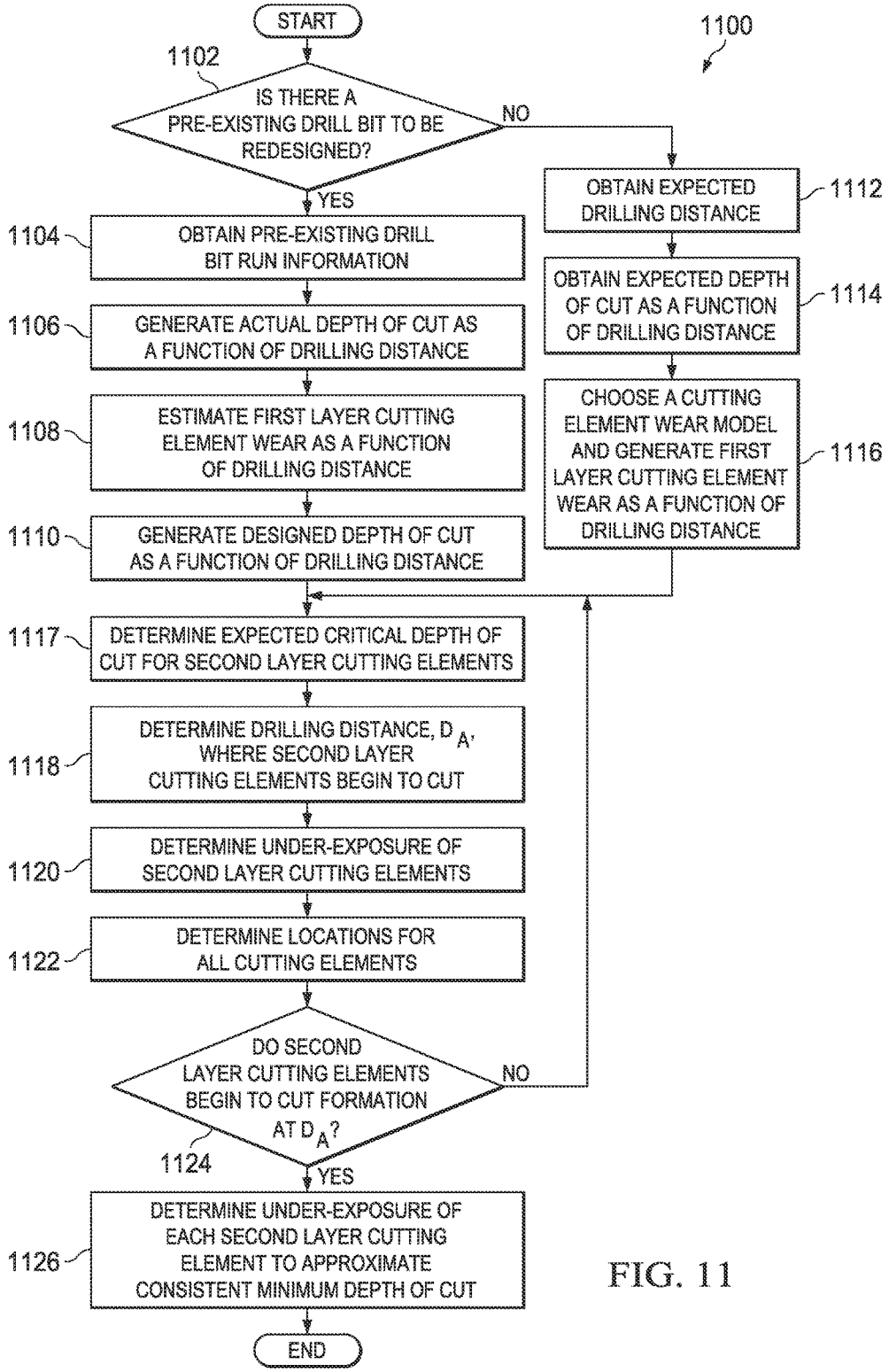
FIG. 11 illustrates a flowchart of an example method for performing a design update of a pre-existing drill bit with second layer cutting elements or configuring a new drill bit with second layer cutting elements, in accordance with some embodiments of the present disclosure.

FIG. 11 illustrates a flowchart of example method 1100 for performing a design update of a pre-existing drill bit with second layer cutting elements or configuring a new drill bit with second layer cutting elements, in accordance with some embodiments of the present disclosure. The steps of method 1100 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

In the illustrated embodiments, the cutting structures of the drill bit, including at least the locations and orientations of all first layer cutting elements, may have been previously designed and bit run data may be available. However in other embodiments, method 1100 may include steps for designing the cutting structure of the drill bit. For illustrative purposes, method 1100 is described with respect to a pre-existing drill bit; however, method 1100 may be used to determine layout of second layer cutting elements of any suitable drill bit. Additionally, method 1100 may be described with respect to a designed drill bit similar in configuration to drill bit 801 as shown in FIG. 8A-8I.

Method 1100 may start, and at step 1102, the engineering tool may determine if a pre-existing drill bit exists that may be redesigned. If there is a pre-existing drill bit, method 1100 continues to step 1104. If no pre-existing drill bit exists, method 1100 continues to step 1112.

At step 1104, the engineering tool may obtain run information for the pre-existing drill bit. For example, FIG. 3 illustrates run information 300 for a pre-existing drill bit. As shown in FIG. 3, run information 300 may include RPM, ROP, MSE, and rock strength.

At step 1106, the engineering tool may generate a plot of the actual depth of cut as a function of drilling depth for the pre-existing drill bit. For example, FIG. 4B illustrates an actual depth of cut plot as a function of drilling depth for a drill bit.

At step 1108, the engineering tool may estimate the average first layer cutting element wear as a function of drilling depth of the pre-existing drill bit. For example, FIG. 5 illustrates an estimate of first layer cutting element wear as a function of drilling depth for a drill bit.

At step 1110, the engineering tool may generate a plot of the designed depth of cut as a function of drilling depth for second layer cutting elements of the pre-existing drill bit. The designed depth of cut may be based on the first layer cutting element wear estimated at step 1106. For example, FIG. 5 illustrates actual depth of cut, plot 530, that begins at approximately 0.2 in/rev and as the first layer cutting elements wear, as shown in FIG. 5, the actual critical depth of cut may correspondingly decrease.

As noted above, if no pre-existing drill bit exists that may be redesigned at step 1102, method 1100 may continue to step 1112. At step 1112, the engineering tool may obtain the expected drilling depth, $D_{max}$, for the wellbore based upon exploration activities and/or a drilling plan. At step 1114, the engineering tool may obtain the expected depth of cut as a function of drilling depth. For example, FIG. 4A may be generated based on expected RPM and expected ROP based on exploration activities and/or a drilling plan.

At step 1116, the engineering tool may receive a cutting element wear model and may plot cutting element wear depth as a function of the drilling depth. For example, FIG. 5 may represent the expected wear of first layer cutting elements based on a model generated by the equation:

$$\text{Wear (\%)}=(\text{Cumwork}/\text{BitMaxWork})^{a}*100\%$$

where

Cumwork=f(drilling depth); and a=wear exponent and is between approximately 5.0 and 0.5.

At this point in method 1100, both step 1116 and step 1110 continue to step 1117. At step 1117, the engineering tool may determine an expected critical depth of cut for the second layer cutting elements. The critical depth of cut may be based on drilling parameters such as RPM and ROP. For example a critical depth of cut for second layer cutting elements for a drill bit operating at approximately 120 RPM with an ROP of 120 ft/hr may be approximately 0.20 in/rev. Additionally, second layer cutting elements may have an initial critical depth of cut that may be greater than the actual depth of cut or the expected depth of cut, as shown with reference to FIG. 5. Further, at a particular drilling distance, $D_A$, second layer cutting element critical depth of cut, plot 520, may intersect with the actual depth of cut, plot 530. At a target drilling depth, second layer cutting element critical depth of cut, plot 520, may be equal to approximately zero.

At step 1118, the engineering tool may determine the drilling depth at which first layer cutting elements on the drill bit may be worn such that second layer cutting elements may begin to cut the formation based on bit wear and actual or expected ROP. This drilling depth may correspond to drilling depth $D_A$.

At step 1120, the engineering tool may determine the under-exposure of second layer cutting elements for the drill bit. The under-exposure may be approximately the amount of wear first layer cutting elements may have experienced while drilling to drilling depth $D_A$. For example, FIG. 5 illustrates an estimate of first layer cutting element wear as a function of drilling depth. Using $D_A$ from step 1118 the engineering tool may determine the average under-exposure of second layer cutting elements as the amount of first layer cutting element wear at drilling depth $D_A$. For example the under-exposure of second layer cutting elements may be determined to be greater than approximately 0.025 inches. The amount of underexposure may be further based on each second layer cutting element having an initial critical depth of cut greater than an actual depth of cut for a first drilling distance and a critical depth of cut equal to zero at a target drilling depth. At the target drilling depth or after a particular drilling distance, the first layer cutting elements may be worn such that at least one second layer cutting element may be cutting into the formation.

At step 1122, the engineering tool may determine the optimal locations for second layer cutting elements and first layer cutting elements disposed on the drill bit. For example, based on the critical depth of cut for the second layer cutting elements and the under-exposure, a drill bit configuration may be selected from Table 1 shown above. As another example, the engineering tool may run multiple simulations to generate run information. Based on results of these simulations, the engineering tool may determine blade locations for both first layer cutting elements and second layer cutting elements.

At step 1124, the engineering tool may determine if the second layer cutting elements begin to cut formation at drilling depth $D_A$. For example, the engineering tool may generate a designed critical depth of cut as a function of drilling depth for second layer cutting elements of the drill bit. The engineering tool may run a simulation of the cutting element layout determined in step 1122 to generate designed critical depth of cut as a function of drilling depth curve. For example, the engineering tool may determine that second layer cutting elements 838 may begin to cut into the formation at drilling depth $D_A$ of approximately 5,000 feet. If second layer cutting elements do not begin to cut formation at drilling depth $D_A$, the process 1100 may return to step 1118 to reconfigure drill bit 801. If the second layer cutting elements begin to cut formation at drilling depth $D_A$, then the process may continue to step 1126.

Based on these results, at step 1126, the engineering tool may adjust under-exposure of each second layer cutting element in order for each second layer cutting element to have the same minimal depth of cut of the new drill bit. Following step 1126, method 1100 may end.

Although the present disclosure and its advantages have been described in detail, it should be understood that various changes, substitutions and alternations can be made herein without departing from the spirit and scope of the disclosure as defined by the following claims. For example, although the present disclosure describes the configurations of blades and cutting elements with respect to drill bits, the same principles may be used to control the depth of cut of any suitable drilling tool according to the present disclosure. It is intended that the present disclosure encompasses such changes and modifications as fall within the scope of the appended claims.

What is claimed is:

1. A multi-layer downhole drilling tool designed for drilling a wellbore including a plurality of formations, comprising:

a bit body;

a plurality of primary blades on exterior portions of the bit body, each primary blade including a leading surface;

a plurality of secondary blades on exterior portions of the bit body, each secondary blade including a leading surface;

a plurality of first layer cutting elements on exterior portions of the primary blades, each first layer cutting element located on the leading surface of a corresponding primary blade; and a plurality of second layer cutting elements on exterior portions of the secondary blades, each second layer cutting element located on the leading surface of a corresponding secondary blade and positioned with respect to a corresponding first layer cutting element such that the second layer cutting element engages a formation at a particular drilling distance, the second layer cutting elements having:

an initial critical depth of cut greater than an actual depth of cut of the first layer drilling elements between a first drilling distance and the particular drilling distance greater than the first drilling distance; and a critical depth of cut equal to zero at a target drilling distance greater than the particular drilling distance.

2. The drilling tool of claim 1, wherein the second layer cutting elements are positioned with respect to corresponding first layer cutting elements according to a formation property of the plurality of formations.

3. The drilling tool of claim 2, wherein the formation property is rock strength.

4. The drilling tool of claim 1, wherein the second layer cutting elements are positioned with respect to corresponding first layer cutting elements according to a critical depth of cut control curve.

5. The drilling tool of claim 1, wherein the second layer cutting elements are positioned with respect to corresponding first layer cutting elements according to an expected property of one of the plurality of formations.

6. The drilling tool of claim 1, wherein each second layer cutting element is track set with the corresponding first layer cutting element.

7. The drilling tool of claim 1, wherein one of the first layer cutting elements is track set with a different first layer cutting element.

8. The drilling tool of claim 1, wherein each of the second layer cutting elements is on a secondary blade rotationally in front of the corresponding first layer cutting element.

9. The drilling tool of claim 1, wherein each of the second layer cutting elements is on a secondary blade rotationally behind the corresponding first layer cutting element.

* * * * *